US011473293B2

(12) United States Patent
Mercolini

(10) Patent No.: US 11,473,293 B2
(45) Date of Patent: Oct. 18, 2022

(54) BUILDING STRUCTURE WITH INDEPENDENTLY CANTILEVERED STORIES

(71) Applicant: LM TECH S.R.L., Milan (IT)

(72) Inventor: Lorenzo Mercolini, Milan (IT)

(73) Assignee: LM TECH S.R.L., Milan (IT)

( * ) Notice: Subject to any disclaimer, the term of this patent is extended or adjusted under 35 U.S.C. 154(b) by 8 days.

(21) Appl. No.: 17/281,176

(22) PCT Filed: Oct. 1, 2018

(86) PCT No.: PCT/IB2018/057610
§ 371 (c)(1),
(2) Date: Mar. 29, 2021

(87) PCT Pub. No.: WO2020/070538
PCT Pub. Date: Apr. 9, 2020

(65) Prior Publication Data

US 2021/0388601 A1 Dec. 16, 2021

(51) Int. Cl.
*E04B 1/346* (2006.01)
*E04B 1/19* (2006.01)
(Continued)

(52) U.S. Cl.
CPC ..... *E04B 1/346* (2013.01); *E04B 1/1903* (2013.01); *E04B 1/3404* (2013.01); *E04B 1/98* (2013.01);
(Continued)

(58) Field of Classification Search
CPC ..... E04B 1/346; E04B 1/1903; E04B 1/3404; E04B 1/98; E04B 2001/1993; B66F 3/46
See application file for complete search history.

(56) References Cited

U.S. PATENT DOCUMENTS 3,125,189 A * 3/1964 Graham ..... E04B 1/346 52/247
3,126,868 A * 3/1964 Ishibashi ..... A01K 31/17 119/438
(Continued)

FOREIGN PATENT DOCUMENTS

EP 1876307 B1 11/2010

OTHER PUBLICATIONS

International Search Report and Written Opinion for corresponding PCT/IB2018/057610 dated May 28, 2019, 10 Pages.

*Primary Examiner* — Rodney Mintz
(74) *Attorney, Agent, or Firm* — Armstrong Teasdale LLP

(57) ABSTRACT

A building structure includes a core extending upright through and supporting the weight of one or more stories of the building structure, each story including one or more floor units, at least one story forming an outer peripheral portion, and an inner support portion through which the story is supported by the core via an interface along the perimeter of the core, wherein the horizontal cross-section of the core has a substantially circular external perimeter at the level of the interface, the interface and the inner support portion of the story, wherein at least one story is stiffened by a space frame extending from the inner support portion to the outer peripheral portion and making the story a self-supporting rigid body cantilevered off the core and structurally independent of all other stories, wherein the story transmits gravity-induced loads to the core via the interface only by means of vertical forces.

14 Claims, 17 Drawing Sheets

(51) Int. Cl.
*E04B 1/34* (2006.01)
*E04B 1/98* (2006.01)
*B66F 3/46* (2006.01)

(52) U.S. Cl.
CPC ..... *B66F 3/46* (2013.01); *E04B 2001/1993* (2013.01)

(56) References Cited

U.S. PATENT DOCUMENTS

| | | | | | |
|---|---|---|---|---|---|
| 3,213,572 | A | * | 10/1965 | Hohla | E04B 1/3404 D25/5 |
| 3,260,028 | A | | 7/1966 | Fraser | |
| 3,719,012 | A | * | 3/1973 | Laurent | E04B 1/3404 52/79.12 |
| 3,895,473 | A | | 7/1975 | Fraser | |
| 3,905,166 | A | | 9/1975 | Kaiser | |
| 4,098,039 | A | * | 7/1978 | Sutelan | E04H 1/04 52/73 |
| 6,742,308 | B1 | | 6/2004 | Johnstone, III et al. | |
| 7,107,725 | B2 | * | 9/2006 | Johnstone, III | H01R 39/64 52/220.8 |
| 7,536,831 | B2 | | 5/2009 | Ratliff et al. | |
| 9,074,364 | B2 | * | 7/2015 | Fisher | F03D 9/25 |
| 2002/0045383 | A1 | * | 4/2002 | Johnstone, III | E04B 1/3465 439/534 |
| 2006/0201071 | A1 | * | 9/2006 | Johnstone, III | E04B 1/3465 52/65 |
| 2006/0230691 | A1 | * | 10/2006 | Fisher | E04B 1/346 52/65 |
| 2006/0248808 | A1 | | 11/2006 | Franco et al. | |
| 2009/0205264 | A1 | | 8/2009 | Fisher et al. | |
| 2021/0404171 | A1 | * | 12/2021 | Mercolini | E04B 1/3465 |

* cited by examiner

FIG. 23
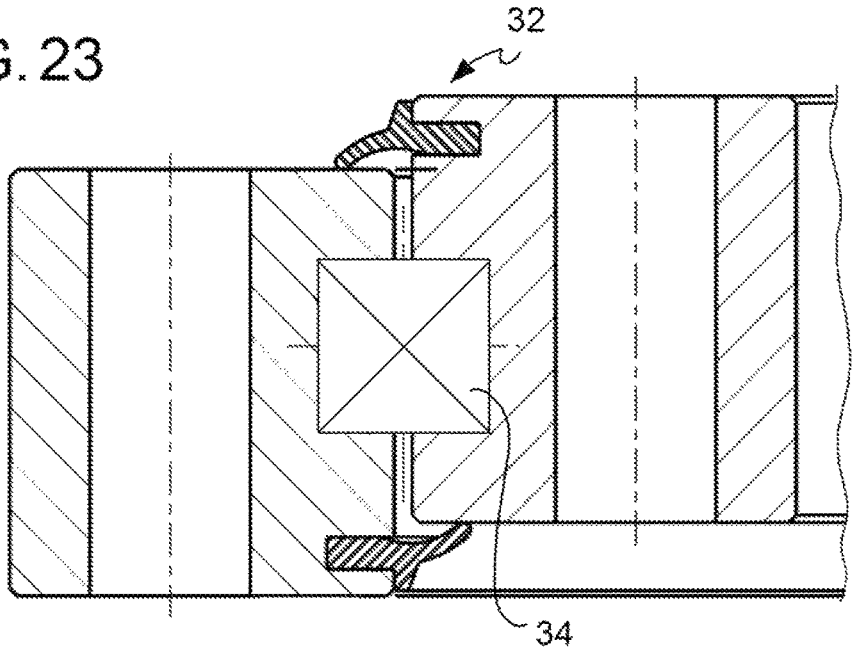
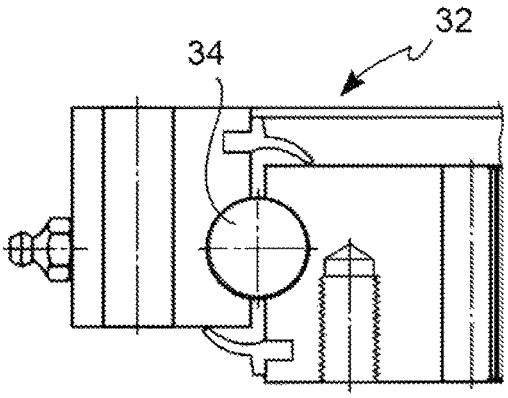
FIG. 24
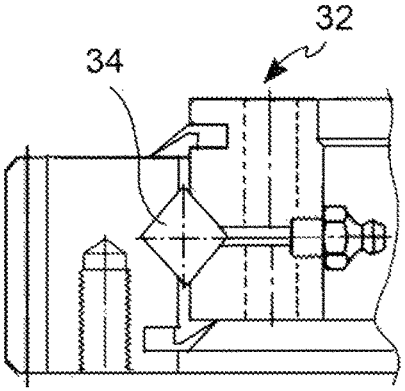
FIG. 25
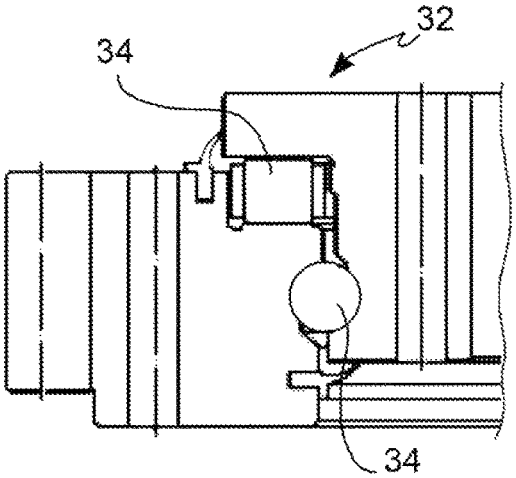
FIG. 26
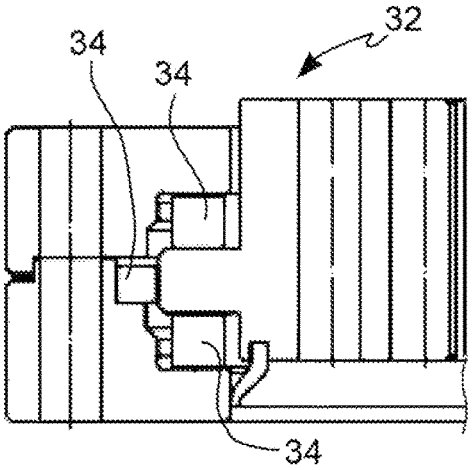
FIG. 27

BUILDING STRUCTURE WITH INDEPENDENTLY CANTILEVERED STORIES

CROSS-REFERENCE TO RELATED APPLICATIONS

This application is a National Phase Application of PCT International Application No. PCT/IB2018/057610, having an International Filing Date of Oct. 1, 2018, which is hereby incorporated by reference in its entirety.

FIELD OF THE INVENTION

The present invention relates to constructing efficiently a multi-story building with only one load-bearing structure which supports all stories. The stories are to be fully cantilevered off said load-bearing structure and independent of one another. Said building is substantially constructed around a vertical axis, wherein the cantilevered stories comprise space frames and do not transmit any horizontal gravity-induced loads to the load-bearing structure (core).

Moreover, the present invention provides the cantilevered stories with an ability to rotate about a vertical axis of the multi-story building.

BACKGROUND OF THE INVENTION

Multi-story buildings have a number of substantially vertical supporting elements, which transfer their weight to the ground. Some buildings make a point of eliminating all structural elements from the interior of the stories, thus allowing the occupants to divide the floor space according to their particular preferences. Such is the case, for example, of 432 Park Avenue in New York City. Such a structural arrangement, however, implies that load-bearing columns must be placed at the building's outer perimeter, thereby hindering the chances of having completely unobstructed 360° views.

SCOPE AND GENERAL DESCRIPTION OF THE INVENTION

The present invention describes a way to eliminate opaque or obstructing structural elements, both within the floor space and at the outer perimeter of the building by having only one vertical element supporting all the stories, which are entirely cantilevered off said supporting element. Thanks to the cantilevered structure of the stories, each structurally independent story can be covered by a very lightweight roof, which is easy to support. An external load-bearing façade or façade portion can support part of the roof's weight.

Furthermore, cantilevering the structurally independent stories generates maximum acoustic insulation between the stories, hence greatly increasing the privacy of the building's occupants. Privacy is a very sought after feature in real estate.

Moreover, the present invention describes a new and efficient way to cantilever many stories off a supporting structure, the so-called core, thereby optimizing weight, rigidity, construction cost and environmental impact.

Another aim of the present invention is to enable the distance between the pavement and the ceiling of a story to vary throughout the story, thanks to a specific shape of the cantilevered structure. In particular, a living unit within the story can have 360° unobstructed views with the ceiling height increasing towards the windows, thus magnifying the impression of open space and maximizing the amount of light entering the living unit. The ability for an apartment or hotel suite to offer expansive views and/or to let in significant amounts of light (corrected by shading elements when needed) generally increases its salability and economic value.

The present invention fulfils the aforementioned goals by exploiting the technology of the space frame, which has been well known for over a century and is currently widely used in the construction industry.

The space frame has several advantages. It is a very rigid and lightweight structure which can allow the building of shapes impossible to realize with other structural systems; it can be partly or entirely prefabricated, thus generating high levels of standardization, precision and quality control; it allows the easy installation of, access to, and maintenance of, any mechanical, electrical, plumbing or fire safety equipment placed within it; it is very resistant to seismic activity because the energy transmitted by an earthquake is dissipated throughout the large number of struts and nodes of the space frame; and the redundancy of the elements constituting the space frame makes the latter very robust, helping prevent it from collapsing in the event of damage.

The main disadvantage of the space frame, apart from any aesthetic consideration, is the relatively high cost of construction for small installations, as well as the operational discipline required to ensure product quality and precise assembly.

The present invention mitigates such disadvantage by repeatedly using identical and/or modular space frame segments for multiple stories in a high-rise building. Furthermore, prefabrication, hoisting and assembly of the structure can be a relatively fast, streamlined process, thus reducing overall construction time. This can prove a key advantage from a return on investment perspective, compensating at least partially any remaining cost differential versus alternative structural systems.

It should also be noted that prefabrication greatly contributes to the building's sustainability credentials.

One particularly advantageous application of the space frame is cantilevered structures. At present, the world's longest cantilevered structure in a building is the roof of the Busan Cinema Center in Busan (Republic of Korea), spanning 85 meters and built from a space frame. The Marina Bay Sands SkyPark in Singapore has the world's longest public cantilever (i.e. which people can walk on) in a building, spanning 65 meters and constructed from steel box girders. The One Za'abeel complex, currently under construction in Dubai, will comprise the Linx, a panoramic sky concourse, which will become the world's longest occupied cantilever (i.e. comprising floors within it) in a building, spanning 64 meters. The Linx will be built using a diagrid structure, which has some conceptual similarities with, and some of the advantages of, space frame structures, in particular with regard to lightness and rigidity.

Because the present invention describes a building whose floor units are exclusively built on structures cantilevered off the core, these cantilevered structures must have the ability to bear all the weight of any typical building story. Because these cantilevers are unlikely to exceed 20 meters in span (versus 64 to 85 meters, as discussed above) they can be realized entirely with space frames, thus retaining this technology's aforementioned advantages, whereas the extensive use of space frames generates the economies of scale mitigating the aforementioned disadvantages.

As shown in the figures, the profile of the space frame supporting the story gradually tapers off towards its outer peripheral portion, enabling the story beneath it to occupy the vertical space made available by the tapering. This allows the internal ceiling of the story below to increase in height towards its outer peripheral portion, thus producing the aforementioned effect of magnifying the impression of open space.

One problem of cantilevered structures, which is not solved by the space frame per se, is the horizontal gravity-induced loads they transmit to the structure supporting them, due to suspension and cantilever moment transmission. Such a problem can be overcome by strengthening the supporting structure. However, if said horizontal loads could be completely eliminated, avoiding all suspension and cantilever moment transmission to the supporting structure, the latter would become much more efficient. An efficient core is less expensive and less energy-intensive to build.

The present invention proposes a way to eliminate completely all horizontal gravity-induced loads transmitted by the cantilevered stories to the core.

In accordance with an aspect of the invention, a first step is to make the story substantially symmetrical about a vertical axis. This allows each cantilevered portion of the story to be substantially counterbalanced by the respectively opposite cantilevered portion with respect to the vertical axis. The most efficient way to achieve this is for the respective section of the core to take substantially the shape of a column of a substantially circular horizontal cross-section. The horizontal diameters of the core cross-sections may be constant or may vary according to the height. The core supports one or more cantilevered stories via one or more corresponding interfaces running along one or more corresponding perimeters of the core. Each interface is therefore of substantially annular shape. The cantilevered story has an inner support portion which rests on the interface, performing the transmission of all loads, and is similarly of substantially annular shape. Each cantilevered story also has an outer peripheral portion which defines an outer surface of the story.

A second step is to attach to the space frame supporting the story an upper and a lower layer or membrane made of a mechanically resistant structural material such as, for example, reinforced concrete, wherein each of the upper and lower layers or membranes forms two sets of ribs. Each rib may be made of the same material as its corresponding layer or membrane, or of a different material, e.g. steel. The first set of ribs consists of a number of substantially radial ribs extending substantially radially to the story's vertical axis between a radially inner edge and a radially outer edge of the layer or membrane. The second set of ribs consists of a number of substantially circumferential ribs, each substantially circumferential rib extending substantially circumferentially around the story's vertical axis and lying in a substantially horizontal plane. The substantially radial and substantially circumferential ribs face (and are part of) the space frame and are therefore formed on the lower face of the upper membrane and on the upper face of the lower membrane. On both the lower and upper membranes each substantially circumferential rib intersects substantially perpendicularly all the substantially radial ribs, and each substantially radial rib intersects substantially perpendicularly all the substantially circumferential ribs. All the space frame nodes, from which the space frame struts extend, are placed on the intersection between a substantially circumferential rib and a substantially radial rib. Due to this geometry, the loads transmitted within the membranes are substantially oriented according to a spatial cylindrical coordinate system. It should be noted that the circular shape is the most efficient one for the substantially circumferential ribs, thanks to the circle's intrinsic cylindrical symmetry and the fact that it lacks singularities which would lead to stress concentrations. The substantially circumferential ribs may however be formed by a sequence of linear rib sections, each of which extending between two nodes of the space frame. In this case, the angle between the circumferential and radial ribs at the nodes is not exactly 90°.

Gravity generates on the space frame flexural stresses perpendicular to the membranes and planar stresses in the local plane of the membranes. All stresses have a vertical component and a component contained in a horizontal plane. All vertical components are entirely transmitted to the core via the interface. All horizontal components are mostly transmitted to the ribs, with a minor portion being transmitted throughout the rest of the membranes. All struts extending downward and radially inward towards the core are subject to compressive stress while all struts extending downward and radially outward towards the façade are subject to tensile stress. On the upper membrane the substantially radial ribs are subject to compressive stress while the substantially circumferential ribs are subject to tensile stress. On the lower membrane the substantially radial ribs are subject to tensile stress while the substantially circumferential ribs are subject to compressive stress. All horizontal gravity-induced loads are self-balanced. Therefore the story transmits to the core only vertical gravity-induced loads.

It should be noted that said supporting space frame hardly generates any increase in the building's floor-to-floor height versus that of ordinary skyscrapers, thereby making this scheme a viable option for real estate developers.

Because only one vertical structure, the core, bears the weight of all the cantilevered stories, it is subject to significant vertical loads. That has the effect of compressing the core, thus making it advantageously much more robust than it would be if it were one of many columns. Such a building structure is therefore inherently more resistant to earthquakes and wind than are most other similar sized buildings. Additional seismic dampers can be placed to further protect the structure from earthquakes.

In order to isolate the building structure's inner components, which include the space frame and the interface, from the external elements (including atmospheric elements), a separation device can be placed substantially circumferentially around the core, either between two stories or between a story and the core, while maintaining the stories' structural independence. The separation device thus defines an internal environment, surrounding the space frame and the interface, and an external environment in contact with the atmosphere. The separation device can be embodied by brushes, liquid seals, or a combination thereof, as shown in the figures.

In the event of strong winds, the separation device may retract while an emergency lockout device (e.g. blinds) placed close to the core and to the story's inner support portion shuts down upon such retraction, in order to ensure continued protection of the internal environment from the external elements. This extends the external environment as radially inward as possible, which has the effect of allowing the strong winds to blow between the stories, thus reducing the horizontal loads exerted by the wind onto the core. Said separation device retraction system and emergency lockout device are not illustrated in the figures but fall within the scope of the present invention.

A further aim of the present invention is to provide ways to perform maintenance of the items present in the building structure's internal environment.

One way implies the lifting of the story. This may be performed by having the core form, at each story, an auxiliary support surface as shown in the figures, on which several jacks can be placed to lift the story. It should be understood that, in accordance with certain embodiments of the present invention, said jacks can be placed directly at the level of the interface, without the need of an auxiliary support surface. It should also be understood that the jacks must not necessarily lift the entire story, although that could be needed in certain circumstances. Jacks can also lift a portion of the story, e.g. so that the portion of the interface near the jacks does not bear its share of the story's weight, thus allowing the items present in the internal environment nearby to be maintained. Jacks can also be used during the initial mounting of the cantilevered story, in order to ease the latter in place with maximum precision.

Other maintenance methods and features are described and illustrated in the figures. In order to access the internal environment for the purpose of inspection or maintenance, trap doors (not illustrated in the figures) can be arranged in the pavement and/or the membrane/s, said trap doors enabling access to the internal environment from the floor unit above it. Trap doors can also be arranged in the ceiling and/or the roof of a story's inner support portion to allow access to the internal environment separating said story from the story directly above it, for the purpose of inspection or maintenance.

In accordance with a further aspect of the invention, there is one very specific type of building for which it is easily demonstrated that the structure hitherto described is by far the most viable one: a building in which each entire story (not only its internal pavement) has the ability to rotate about the core.

The feature of an apartment or hotel suite of providing a desirable view determines its salability and economic value. In addition, the ability to change external appearance and shape can significantly increase the appeal of a residential and/or commercial (e.g. hotel or conference) building for potential clients and/or investors. Moreover, the ability to reposition individual stories of a multistory building in order to purposely change their exposure (e.g. to sunlight or shadow), or their access to external infrastructure can be required for the purpose of energy saving or for meeting specific requirements in civil, industrial or military applications.

Known examples of rotatable buildings are observation towers and restaurants that are frequently single story, or top-story only, rotatable installations which provide users with changeable views. Examples of such structures are shown e.g. in U.S. Pat. Nos. 3,905,166, 6,742,308, and 8,414,68.

Further examples of rotatable buildings are multistory apartment buildings or hotels with a selective 360° viewing capability and an individual or independent rotation of single stories. Examples of such buildings have been described e.g. in US2009/205264A1 and US2006/0248808A1.

The known multistory rotatable buildings have in common certain drawbacks and critical aspects contributing to high erection and operation costs, and precluding a fully reliable operation and acceptance thereof by investors. One of these critical aspects is to ensure the distribution and transmission of services (electricity, data, clean water, wastewater, etc.) between the stationary support structure and the rotatable stories. Another critical aspect is to ensure the structural reliability and maintenance of the rotatable support and rotating capability of the stories over decades of service life of the building.

While a co-pending patent application by the author describes a way to ensure the aforementioned distribution and transmission of services, the present invention describes a way to solve the latter critical aspect.

The invention provides a rotatable multistory building, which retains all the structural advantages described above. In particular, the present invention describes a way of building a plurality of stories whose entire structure rotates, not just the pavement as in most previous inventions and realizations. Whereas other previous inventions have described ways of building a plurality of stories whose entire structure rotates, they either, as in the case of U.S. Pat. No. 7,536,831 B2, do not provide indications concerning the structure of the stories, focusing more on the transmission of services between the fixed part and the rotatable part, or, as in the case of EP1876307B1, describe stories suspended from the core, hence transmitting gravity-induced loads to the core also by means of horizontal forces; place platforms extending from the core to provide access to the story; and, more generally, do not provide a detailed structural solution to the cantilevering of the stories.

In the rotatable embodiment of the building structure, the interface between the cantilevered story and the core may be in the form of substantially annular rolling track means comprising at least one substantially annular rolling track extending substantially circumferentially around the stationary core and fixed either to the stationary core or to the substantially annular support portion of the rotatable story, and a plurality of rolling elements or wheels rollably engaging the substantially annular rolling track/s for a rotatable coupling of the inner annular support portion of the story to the stationary core, wherein the rotatable story can rotate about the stationary core in a substantially horizontal story rotation plane.

It should be understood that any embodiment wherein the interface between the cantilevered story and the core is in the form of any other existing or yet to be invented device, enabling the movement of the rotatable story with respect to the stationary core, falls within the scope of the present invention. Such device can apply, for example, the well-known technology of magnetic levitation. Alternatively, the story can rotate by slidingly engaging a track made of a material with a very low coefficient of friction, such as Teflon. The present description of the invention will provide further details only for the annular rolling track means embodiment described above.

In order to impart a rotation to a cantilevered story, drive means are positioned at said rotatable story. It should be understood that any embodiment wherein the drive means are in the form of any existing or yet to be invented device, capable of imparting said rotation, falls within the scope of the present invention. Such device can apply, for example, the well-known technologies of electromechanical, electromagnetic, hydraulic, pneumatic, or any fuel-based propulsion. The present description of the invention will provide further details only for embodiments based on electromechanical or electromagnetic propulsion.

These and other aspects and advantages of the present invention shall be made apparent from the accompanying figures and the description thereof, which illustrate embodiments of the invention and, together with the general description of the invention given above, as well as the detailed description of the embodiments given below, serve to explain the principles of the present invention.

BRIEF DESCRIPTION OF THE FIGURES

In the accompanying figures, which show exemplary non-limiting embodiments of the invention:

FIGS. 23 to 29 are partial vertical cross-section views of embodiments of rolling track means configured as a slewing bearing.

DETAILED DESCRIPTION OF THE INVENTION

Figure 1B:
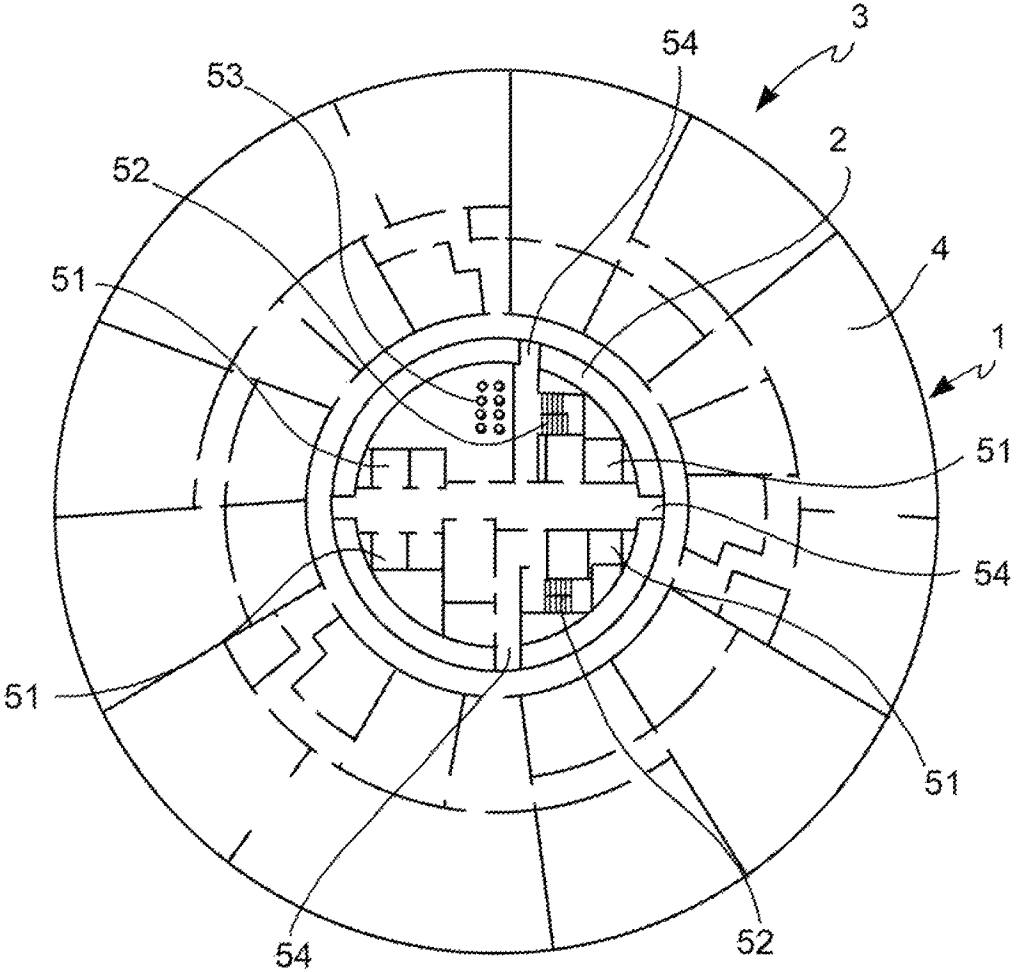
FIG. 1B is a horizontal cross-section view of a story of a building in accordance with an embodiment.
Figure 1A:
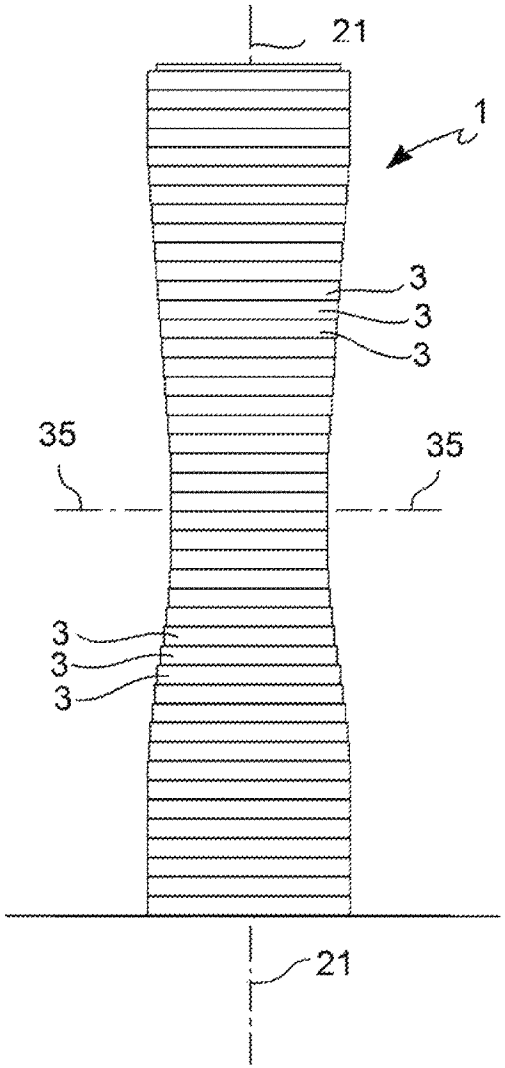
FIG. 1A is a side elevation view of a multi-story building in accordance with the invention having independently cantilevered and possibly rotatable stories surrounding a central core.
Figure 2:
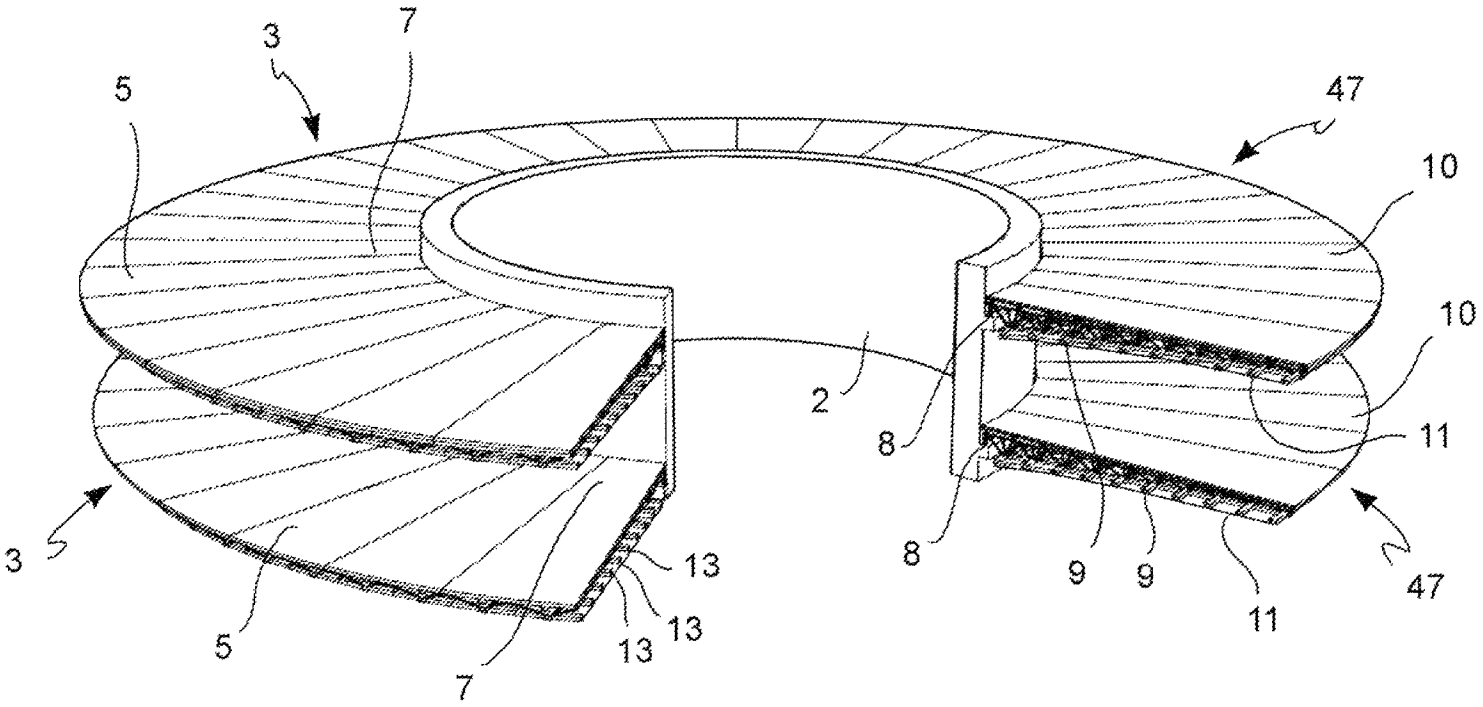
FIG. 2 is a partial perspective view of the core and bottom plate structures of a building with space frame stiffened stories in accordance with an embodiment.
Figure 3:
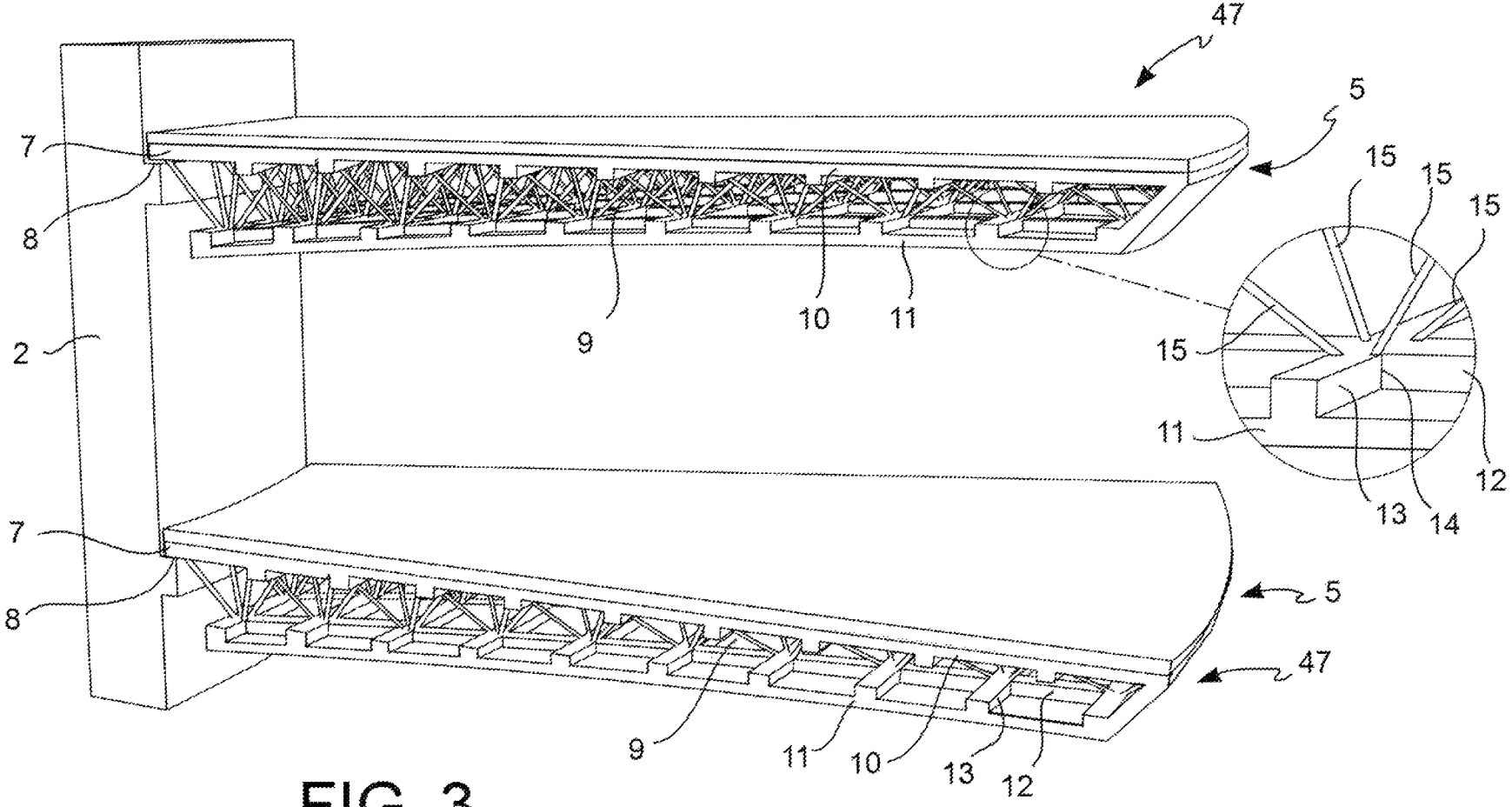
FIG. 3 is a partial perspective view of structural components of a building with space frame stiffened stories in accordance with an embodiment.
Figure 4:
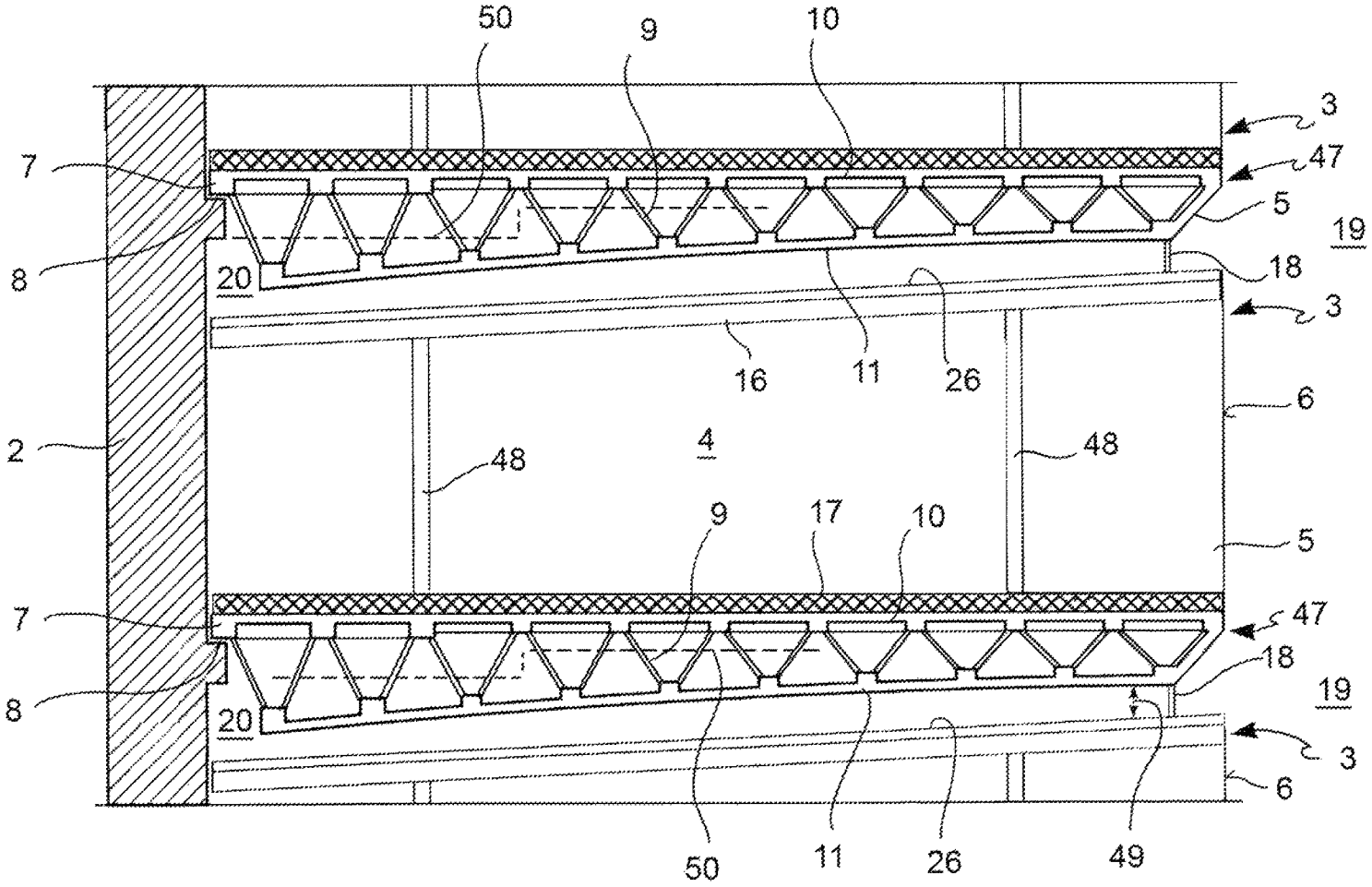
FIG. 4 is a partial vertical cross-section view of a building with space frame stiffened stories in accordance with an embodiment.
Figure 5A:
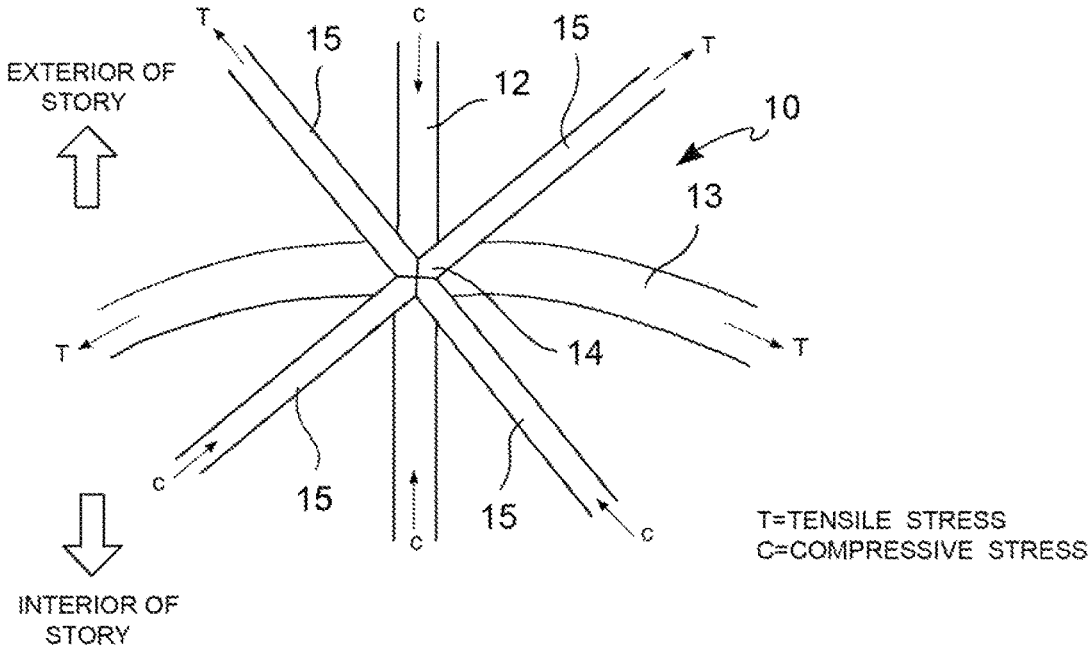
FIG. 5A is a schematic view from below of an upper membrane of a space frame of a story.
Figure 5B:
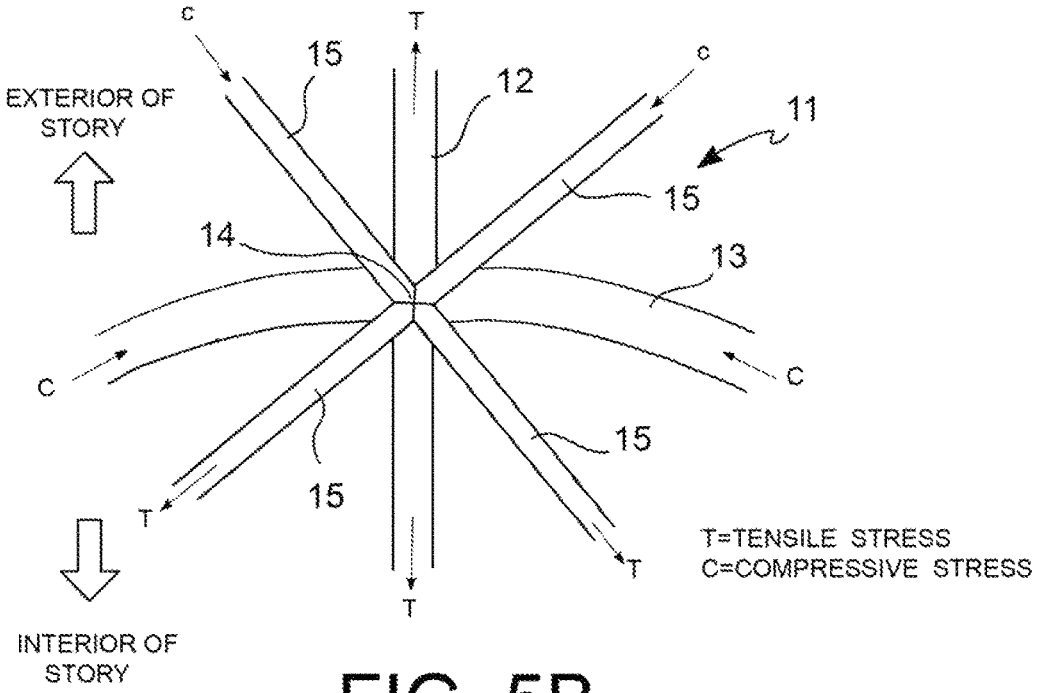
FIG. 5B is a schematic view from above of a lower membrane of a space frame of a story.

In accordance with an aspect of the invention, a building structure 1 comprises a core 2 extending upright through and supporting the weight of one or more stories 3 of the building structure 1, each story 3 comprising one or more floor units 4 (FIGS. 1A and 1B). Each story 3 forms an outer peripheral portion 5 which defines an outer surface 6 of the story 3, and an inner support portion 7 through which the story 3 is supported by the core 2 via a (coupling- or connecting-) interface 8 along the perimeter of the core 2. The horizontal cross-section of the core 2 has a substantially circular external perimeter at the level of the interface 8, and the interface 8 and the inner support portion 7 of the story 3 are both of substantially annular shape. Each story 3 is stiffened by a space frame 9 extending from the inner substantially annular support portion 7 to the outer peripheral portion 5 and makes the story 3 a self-supporting rigid body cantilevered off the core 2 and structurally independent of all other stories 3 (FIGS. 2, 3 and 4).

The inner support portion 7 of the story 3 and the corresponding interface 8 may be positioned below the story 3, in which case the inner support portion 7 is formed in proximity of the pavement 17 (FIG. 4), or above the story 3, in which case the inner support portion 7 is formed in proximity of the ceiling 16 (embodiment not illustrated in the figures).

Thanks to the space frame 9 structure of the story 3, the latter becomes very lightweight and rigid, thus reducing its gravitational load, while counterbalancing the bending moments it generates thanks to its substantially annular shape, assuming a minor effect on the overall balance of the story 3 of the possibly non-circular horizontal cross-section of the outer periphery of the story 3 and, more generally, assuming a minor effect on the overall balance of the story 3 of a possibly non-symmetrical weight distribution of the story 3 about the vertical axis 21 (which can be an axis of substantial symmetry) of the core 2 or of the respective section of the core 2. The core 2 may have different axes of substantial symmetry at different elevations.

Radial loads and tilting moments transmitted to the core 2 will hence be reduced and prevalently generated by wind and earthquake or, exceptionally, by human- or machine-induced inertial loads acting inside or on the stories 3. Importantly, the story 3 will transmit gravity-induced loads to the core 2 via the interface 8 always only by means of vertical forces.

In conformity with the general meaning in the field of structural engineering, the terminology "space frame" is to be understood as a truss-like, lightweight rigid structure constructed from interlocking struts 15 in a geometric pattern. This geometric pattern need not necessarily be constant over the entire extension of the story 3, but may vary both with respect to the dimension and cross-section of the struts 15 and with respect to the shape of the geometric pattern.

The space frame 9 is enveloped by an upper membrane 10 and a lower membrane 11, each membrane 10, 11 having a number of substantially radial ribs 12 and substantially circumferential (e.g. circular) ribs 13 intersecting each other in space frame 9 nodes 14. All the space frame 9 nodes 14, from which the struts 15 extend, are placed at the intersection of a substantially radial rib 12 and a substantially circumferential rib 13, so that horizontal gravity-induced loads are self-balanced within the ribs 12, 13 and in the membranes 10, 11 (FIG. 3).

In accordance with an embodiment, a floor unit 4 within the story 3 has an interior ceiling 16 and an opposite interior pavement 17 whose vertical distance can vary throughout the floor unit 4 (FIG. 4).

Figure 6:
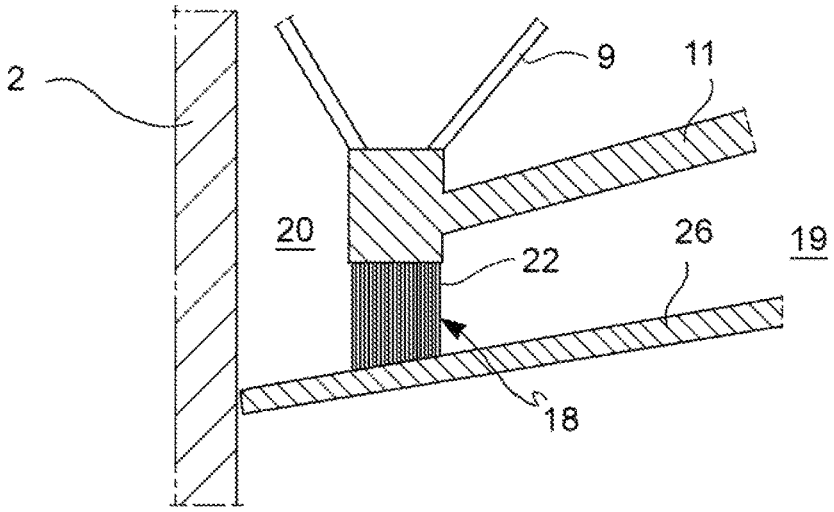
FIG. 6 is a vertical cross-section view of a brush separation device between an external environment and an internal environment of the building structure in accordance with an embodiment.
Figure 7:
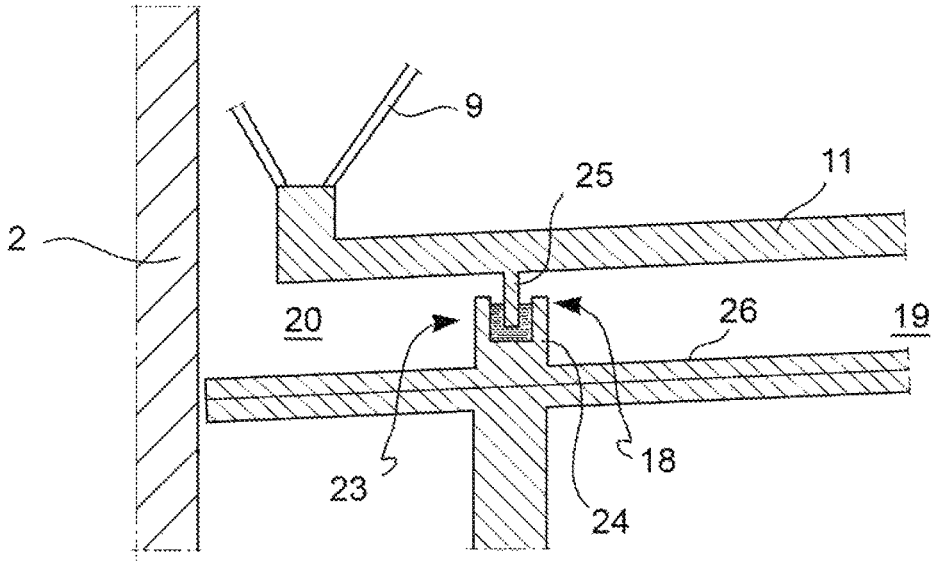
FIG. 7 is a vertical cross-section view of a liquid seal separation device between an external environment and an internal environment of the building structure in accordance with an embodiment.
Figure 8:
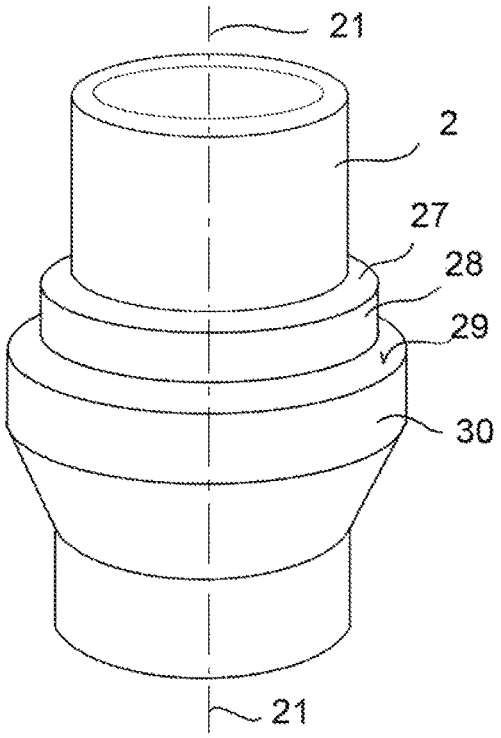
FIG. 8 is a perspective view of a portion of a core of the building structure of this invention.
Figure 9:
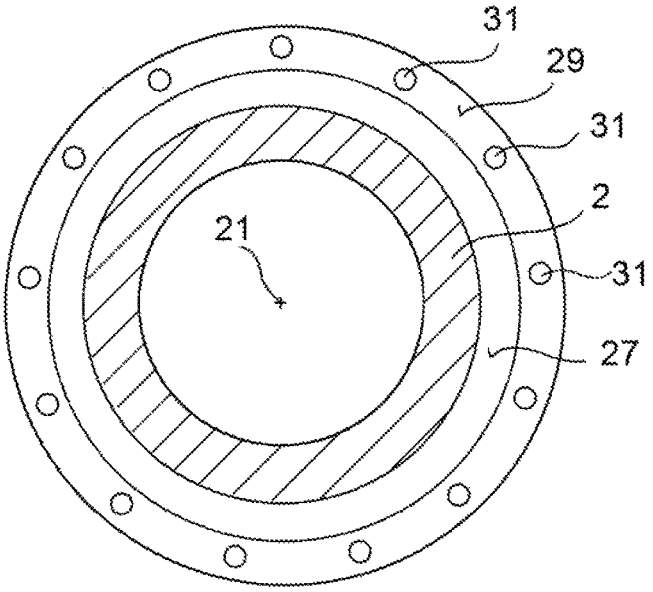
FIG. 9 is a horizontal cross-section view of the core in FIG. 8, showing the position of the core, of a primary support surface for the interface, of an auxiliary support surface, and exemplary positions of auxiliary story support means.
Figure 10:
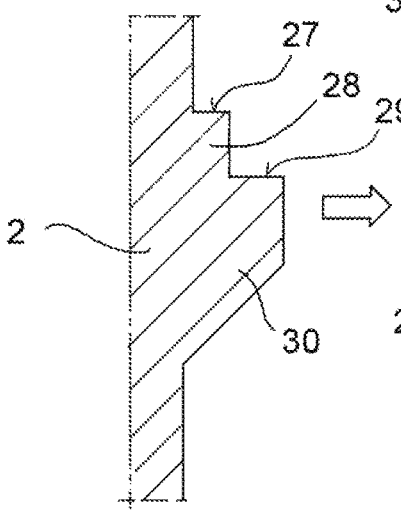
FIG. 10 is a partial vertical cross-section view of the stationary core in FIG. 8.
Figure 11:
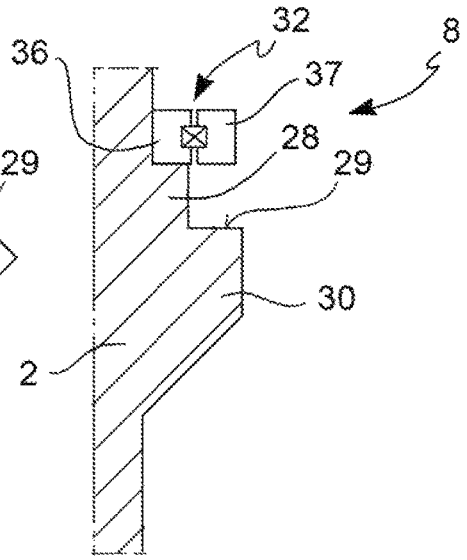
FIG. 11 is a partial vertical cross-section view of the stationary core in FIG. 8, equipped with annular rolling track means, schematically shown as a slewing bearing.
Figure 12:
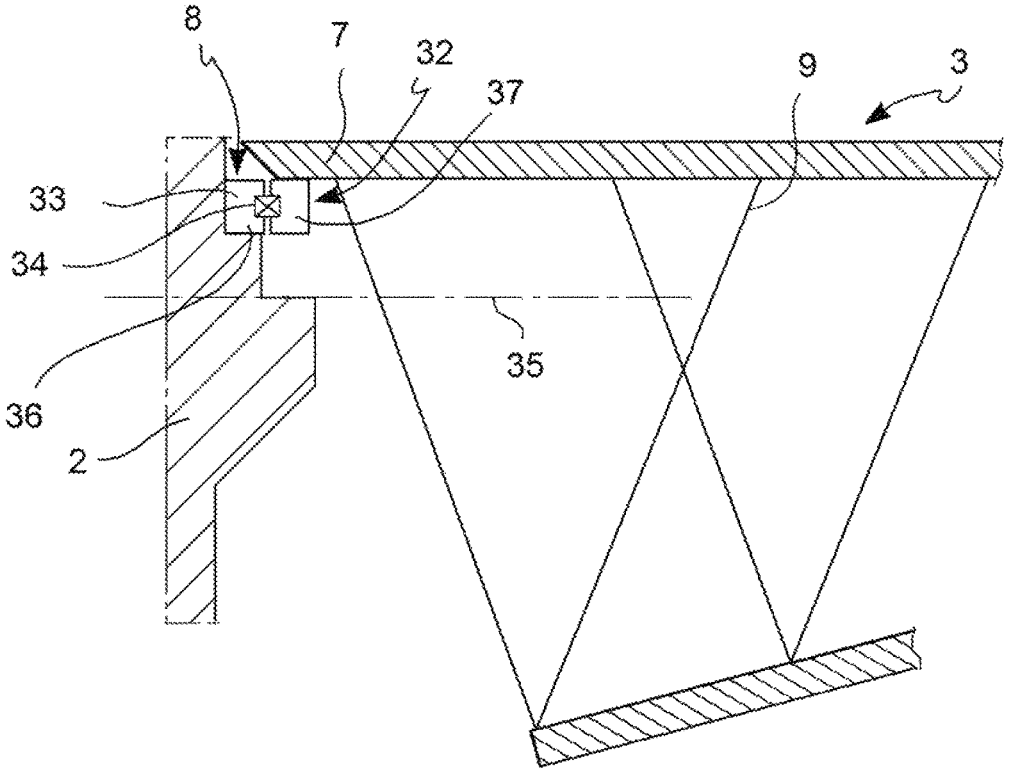
FIG. 12 is a partial vertical cross-section view of a building in accordance with an embodiment, showing a rotatable and load-bearing coupling region between the stationary core and a rotatable story, wherein the rolling track means are schematically shown as a slewing bearing.
Figure 13:
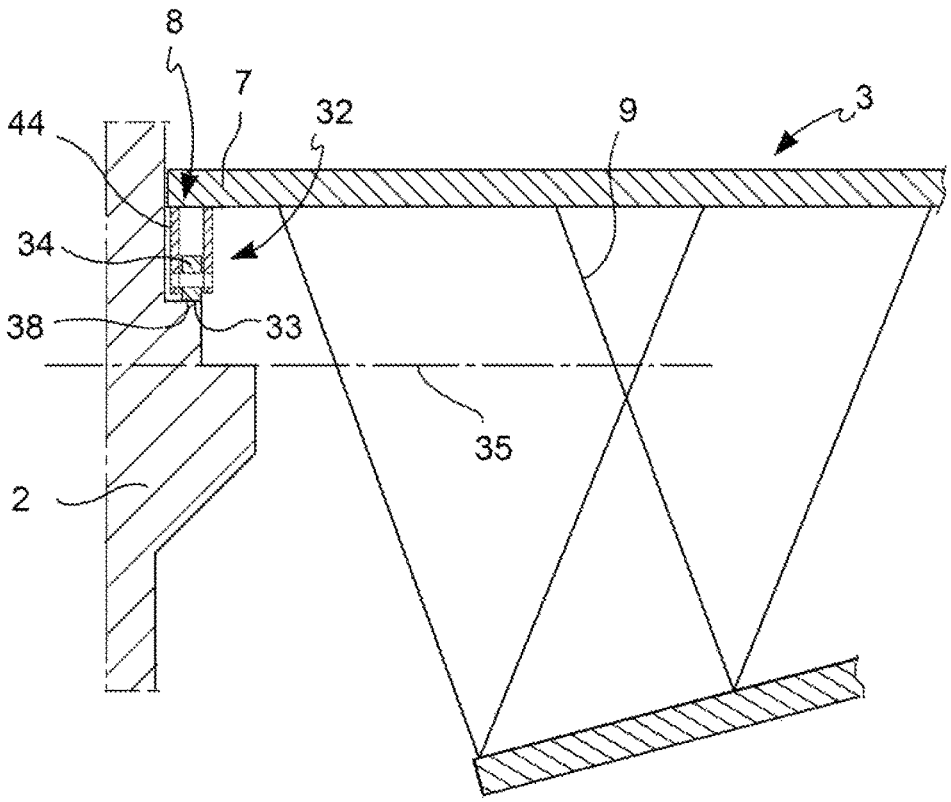
FIG. 13 is a variation of FIG. 12, in accordance with a further embodiment, wherein the rolling track means are schematically shown as a rail-wheel assembly.

In an advantageous embodiment, the building structure 1 comprises one or more separation devices 18 arranged between two vertically neighboring stories 3 and configured to separate an external environment 19 of the building structure 1, which is in contact with all atmospheric elements, from an internal environment 20 of the building structure 1, which is in contact with the space frame 9 and the interface 8. Said separation device 18 can be placed either close to the inner support portion 7 (as shown in FIGS. 6 and 7), close to the outer peripheral portion 5 (as shown in FIG. 4), or at any radial position therebetween. The separation device 18 can also be placed as an extension of the façades of two vertically neighboring stories 3.

The separation device 18 may comprise a brush 22 extending substantially circumferentially around (the vertical axis 21 of) the respective section of the supporting core 2 and being connected to one story 3 and brush-sealingly engaging a vertically neighboring story 3 or the core 2, or vice versa (FIG. 6).

Alternatively, or in addition, the separation device 18 may comprise a liquid seal 23 extending substantially circumferentially around (the vertical axis 21 of) the respective section of the supporting core 2 and comprising a trough 24 containing a liquid, and a separation lip, wall or sheet 25 projecting into the trough 24 and being immersed in said liquid, wherein the trough 24 is fixed to one story 3 or to the core 2, and the separation lip, wall or sheet 25 is fixed to a vertically neighboring story 3, or vice versa (FIG. 7).

One or more horizontal surfaces of the separation device 18 may be covered with damping layers (not illustrated in the figures) made of shock absorbing material such as some polymers, in order to protect the separation device 18, as well as to contribute to the damping of the entire building, during extreme events such as earthquakes.

The liquid seal 23 of the separation device 18 may comprise a drainage system (not illustrated in the figures) which allows the liquid to flow out of the liquid seal 23, and a replenishing system for feeding fresh liquid into the liquid seal 23, thus preventing the liquid from becoming stagnant. If the roof 26 of the story 3 decreases in height radially towards the core 2, drainage of the liquid can be made along a drainage line parallel to the roofline in order to exploit the force of gravity attracting the liquid towards the core 2 for evacuation.

In the liquid seal 23 of the separation device 18, the radial and vertical clearance between the separation lip, wall or sheet 25 and the internal walls and bottom of the trough 24 must be sufficient to ensure that during a destabilizing event such as an earthquake the separation lip, wall or sheet 25 will not come in contact with the internal walls and/or the bottom of the trough 24.

In the liquid seal 23 of the separation device 18 the immersed portion of the separation lip, wall or sheet 25 must be sufficiently high to ensure immersion of the separation lip, wall or sheet 25 and, hence, separation of the external environment 19 from the internal environment 20 also when the entire story 3, or part of it, is lifted, e.g. for maintenance.

In accordance with an embodiment, at a story 3 the core 2 forms a continuous, substantially circumferentially extending, upward facing, e.g. horizontal, primary support surface 27 formed either by a substantially radially outward protruding substantially circumferential primary support shoulder or corbel 28 (FIGS. 8 to 11) or by a substantially radially inward extending substantially circumferential support channel (not illustrated in the figures), wherein the primary support surface 27 supports the corresponding interface 8 and transfers substantially the entire loads from the story 3 to the core 2.

In an alternative embodiment (not illustrated in the figures), at a story 3 the core 2 forms a discontinuous, substantially circumferentially extending, upward facing, e.g. horizontal, primary support surface 27 formed by a substantially circumferential sequence of substantially radially outward protruding primary support shoulders or corbels 28 with free access spaces therebetween. The primary support surface 27 supports the corresponding interface 8 and transfers substantially the entire loads from the story 3 to the core 2. In this embodiment, should portions of the interface 8 span the free access spaces between neighboring primary support corbels 28, those portions would support the interface 8 in the manner of beam structures.

The primary support surface 27 has a radial width of at least 40 cm, preferably of between 40 cm and 70 cm.

Preferably a fixed part of the interface 8 is releasably secured to an anchor portion of the primary support surface 27, e.g. by screwing or bolting, such as to facilitate maintenance and/or replacement of worn-out parts.

Figure 20A:
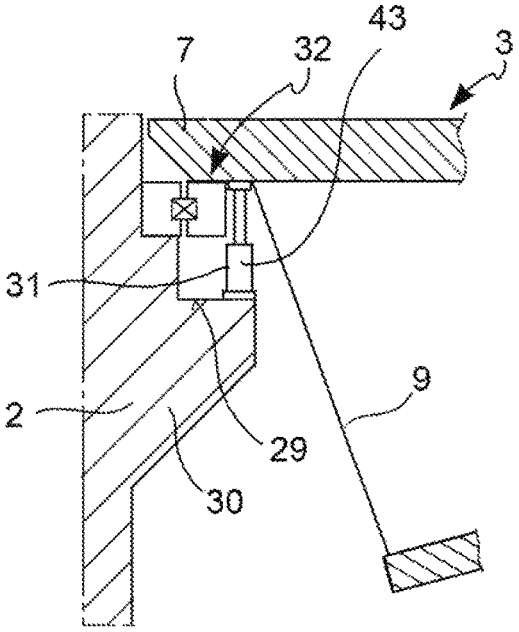
FIGS. 20A and 20B are partial vertical cross-section views of a building in accordance with an embodiment, showing a lifting operation of the rotatable story with respect to its planned position of support by the stationary core, for the purpose of maintenance and/or replacement of components of the rolling track means, which are schematically shown as a slewing bearing.
Figure 20B:
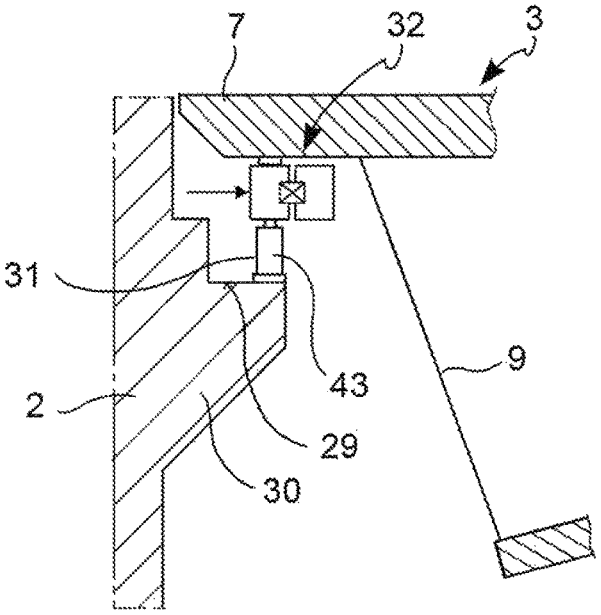

In accordance with a further embodiment, at a story 3 the core 2 forms a continuous or discontinuous, substantially circumferentially extending, upward facing, e.g. horizontal, auxiliary support surface 29 formed either by one or more substantially radially outward protruding auxiliary support shoulders or corbels 30 (FIGS. 8 to 11) or by a substantially radially inward extending substantially circumferential auxiliary channel or sequence of cavities (not illustrated in the figures). The auxiliary support surface 29 may be positioned vertically spaced from (e.g. below) the primary support surface 27, or directly formed by the primary support surface 27, or formed at the same vertical height as the primary support surface 27, and may support auxiliary story support means 31 for temporarily supporting the story 3, to allow maintenance of the interface 8 or of other elements within the internal environment 20, such as building installations 50 (FIGS. 20A and 20B). When not directly formed by the primary support surface 27, the auxiliary support surface 29 has a radial width of at least 20 cm, preferably of between 20 cm and 50 cm.

The primary support corbel/s 28 and the auxiliary support corbel/s 30 is/are preferably made of the same material as that of the core 2 (e.g. structural steel or reinforced concrete), in which case they may be constructed together with the core 2 at each corresponding level, e.g. via a jump form system.

Possible single protrusions or surface sections forming together the primary support surface 27 are preferably coplanar. Similarly, possible single protrusions or surface sections forming together the auxiliary support surface 29 are preferably coplanar. When the primary support surface 27 and the auxiliary support surface 29 are formed at the same vertical height, they are preferably coplanar.

In an embodiment the auxiliary support surface 29 coincides with the primary support surface 27, therefore all or part of the aforementioned functions carried out by the auxiliary support surface 29 (including, but not limited to, the support of auxiliary story support means 31) are carried out by the primary support surface 27.

In accordance with an aspect of the invention, the interface 8 between the inner substantially annular support portion 7 of the story 3 and the core 2 comprises rolling track means 32 having at least one substantially annular rolling track 33 extending substantially circumferentially around the stationary core 2 and fixed either to the stationary core 2 or to the inner support portion 7 of the story 3, and a plurality of rolling elements or wheels 34 rollably engaging the rolling track/s 33 for a rotatable coupling of the inner support portion 7 of the story 3 to the stationary core 2, thus enabling the story 3 to rotate about the stationary core 2 in a substantially horizontal story 3 rotation plane 35. Configuring the interface 8 as rolling track means 32 on two or more stories 3 enables these stories 3 to rotate about the stationary core 2 independently of one another.

In accordance with an embodiment of the rolling track means 32, there is only one rolling track 33 and the rolling elements or wheels 34 are connected to the one of the stationary core 2 and the inner support portion 7 of the rotatable story 3, which the rolling track 33 is not fixed to.

In accordance with an alternative embodiment of the rolling track means 32 (not illustrated in the figures), there are two rolling tracks 33, one fixed to the stationary core 2 and the other fixed to the inner support portion 7 of the rotatable story 3, and the rolling elements or wheels 34 are sandwiched between these two rolling tracks 33 and are connected to neither of them.

In accordance with an embodiment, there is only one rolling track 33 and the substantially annular rolling track means 32 comprise a single substantially annular slewing bearing having a fixed bearing ring 36 (forming the rolling track 33) extending substantially circumferentially around the stationary core 2 and fixed to the stationary core 2, and a rotatable bearing ring 37 fixed to the inner substantially annular support portion 7 and rotatably coupled to the fixed bearing ring 36 by means of the interposition of a plurality of rolling elements 34, e.g. rollers, cylinders, needles, spheres, thus enabling the rotation of the story 3 about the stationary core 2.

In accordance with an alternative embodiment, there is only one rolling track 33 and the substantially annular rolling track means 32 comprise a rail-wheel assembly having a single substantially annular rail 38 forming the rolling track 33, and a plurality of wheels 34 arranged to abut on the single rail 38 and adapted to roll along the single rail 38 to enable the rotation of the rotatable story 3 about the stationary core 2. The single annular rail 38 may be fixed to the stationary core 2 and the wheels 34 rotatably held by wheel suspensions or wheel holders 44 fixed to the inner substantially annular support portion 7 of the story 3, or vice versa.

In these embodiments the primary support surface 27 supports the rolling track means 32 and transfers substantially the entire loads from the rotatable story 3 to the stationary core 2.

A stationary part of the rolling track means 32, e.g. the rolling track 33 or the single rail 38 (in an embodiment of the rolling track means 32 as a rail-wheel assembly), or the fixed wheel suspensions or wheel holders 44 (in an alternative embodiment of the rolling track means 32 as a rail-wheel assembly), or the fixed bearing ring 36 (in an embodiment of the rolling track means 32 as a slewing bearing assembly) is/are anchored to the primary support surface 27 by shape coupling, screw connection, welding and/or clamping to a corresponding anchor portion formed by, or fixed to, the stationary core 2. Preferably said stationary part of the rolling track means 32 is releasably secured to said anchor portion, e.g. by screwing or bolting, such as to facilitate maintenance and/or replacement of worn-out parts.

In accordance with the aforementioned embodiment of the rolling track means 32 as a rail-wheel assembly, such assembly may be complemented by a device (not illustrated in the figures) which pushes or pulls one of the wheel holders 44 (one or more wheel holders 44 individually or together) and the single rail 38 towards the other one of the wheel holders 44 (one or more wheel holders 44 individually or together) and the single rail 38, thus ensuring uninterrupted contact between the wheels 34 and the single rail 38, which prevents any unintentional interruption of the ability of the wheels 34 to support the rotatable story 3. Said device may have the ability to be operated in reverse, thus disengaging one or more wheels 34 from the single rail 38, e.g. for maintenance.

The building structure 1 may comprise, at one or more of said rotatable stories 3, drive means 39 for imparting a rotation to said one or more rotatable stories 3.

In accordance with an embodiment of the drive means 39, the drive means 39 comprise one or more (e.g. eight) electric motors 40, preferably brushless electric motors 40, for each rotatable story 3, positioned along a substantial circumference of the stationary core 2, and configured to impart a motion to one or more corresponding drive members 41 connected to one of the stationary core 2 and the rotatable story 3, and which engage one or more corresponding driven members 42 connected to the other one of the stationary core 2 and the rotatable story 3, such as to rotate the story 3 about the stationary core 2. In a preferred embodiment (FIGS. 16 to 18C), the one or more electric motors 40 and their corresponding drive members 41 are connected to the stationary core 2 and the driven members 42 are fixed to the rotatable story 3. This allows the motors 40 to pick up electric power directly from the stationary core 2, without the need to transmit to the story 3, via a rotational joint, the power required to actuate the motors 40.

Figure 18A:
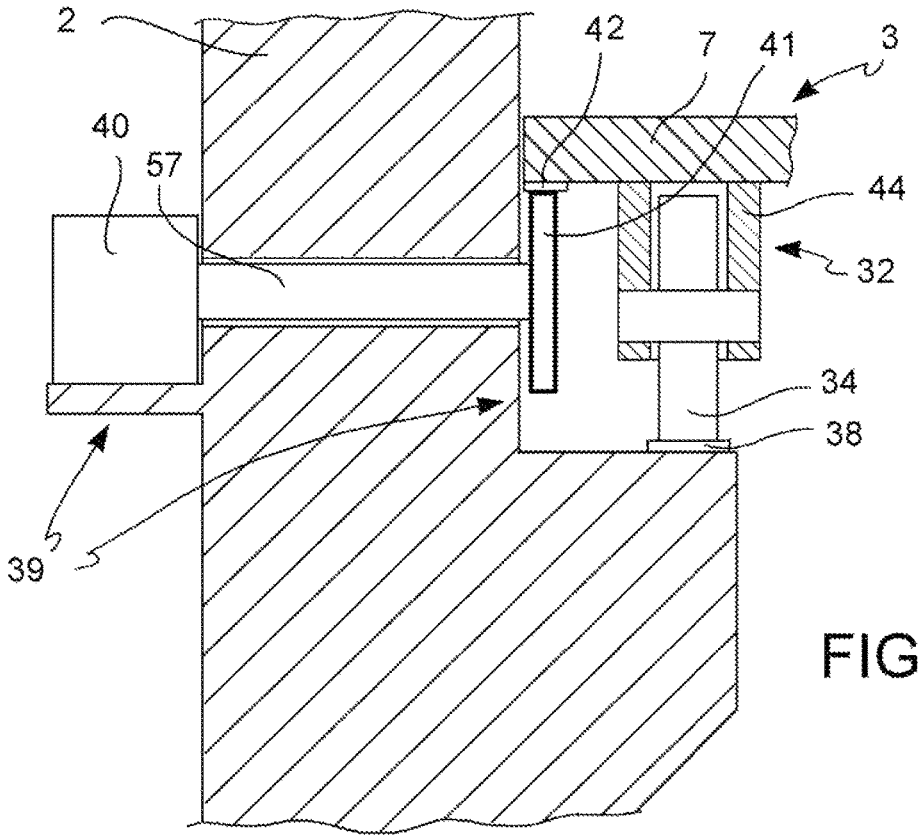
FIG. 18A is a partial vertical cross-section view of a building in accordance with a further embodiment, showing a drive equipment for imparting a rotation to a rotatable story about a stationary core, wherein the rolling track means are shown as a rail-wheel assembly, and wherein an electric motor is positioned at the interior of the core and imparts a motion to a corresponding drive member positioned at the exterior of the core via a shaft placed through a core cavity. In this figure the primary and auxiliary support surfaces coincide and the wheel is held by the rotatable story.
Figure 18B:
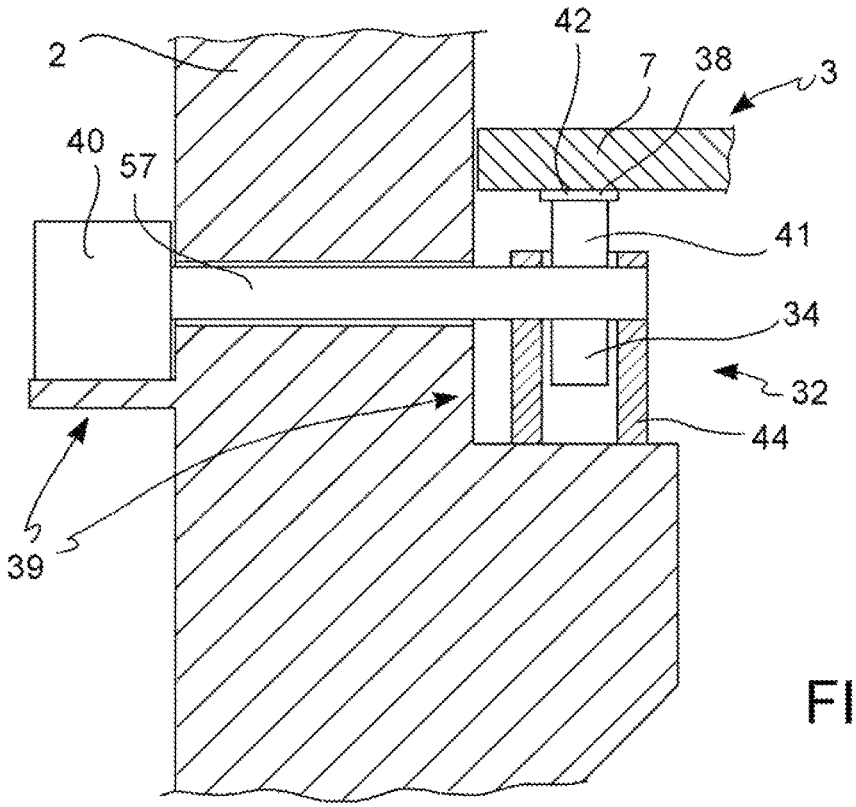
FIG. 18B is a variation of FIG. 18A, in accordance with a further embodiment, wherein the wheel is connected to the stationary core and rolls on the same track as does the drive member.
Figure 18C:
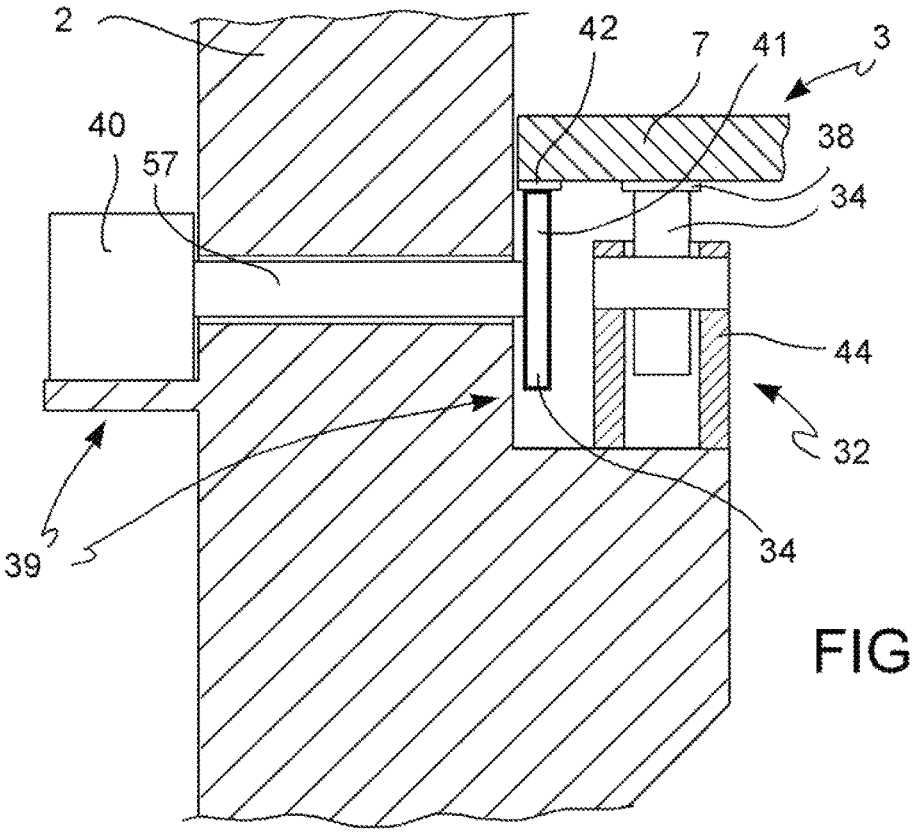
FIG. 18C is a variation of FIG. 18A, in accordance with a further embodiment, wherein the wheel is connected to the stationary core and rolls on a different track from that of the drive member.

In line with this embodiment, every motor 40 is preferably positioned at the interior of the stationary core 2 and imparts a motion to its corresponding drive member 41, which is positioned at the exterior of and connected to the stationary core 2, via a shaft 57 placed through a stationary core 2 cavity (FIGS. 18A to 18C). This arrangement presents the advantages of facilitating motor 40 ventilation by placing them in proximity to one or more ventilation ducts within the stationary core 2; facilitating motor 40 maintenance and/or replacement by providing convenient access to them from the elevator shaft/s 51; and eliminating any noise disturbance from the motors 40 by enabling them to become easily shrouded.

Figure 16:
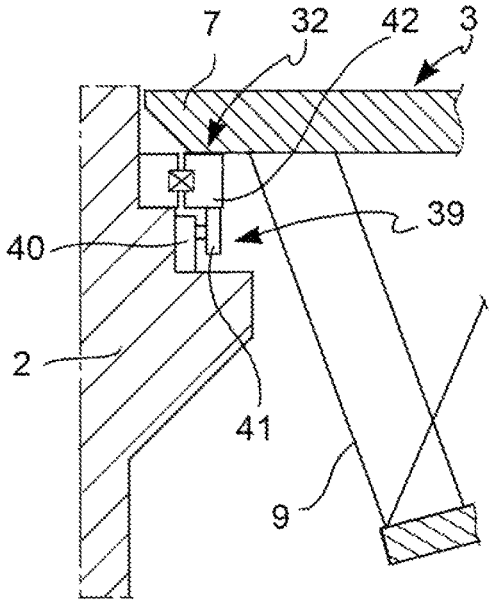
FIG. 16 is a partial vertical cross-section view of a building in accordance with an embodiment, showing a drive equipment for imparting a rotation to a rotatable story about a stationary core, wherein the rolling track means are schematically shown as a slewing bearing, and wherein both the motor and the corresponding drive member are positioned at the exterior of the core. The driven member coincides with the rotatable bearing ring.
Figure 17A:
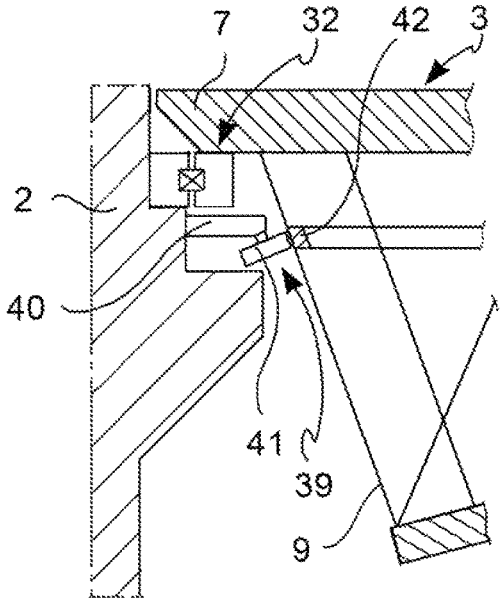
FIG. 17A is a variation of FIG. 16, in accordance with a further embodiment, wherein the driven member is a friction track or toothed surface fixed to the space frame of the rotatable story.
Figure 17B:
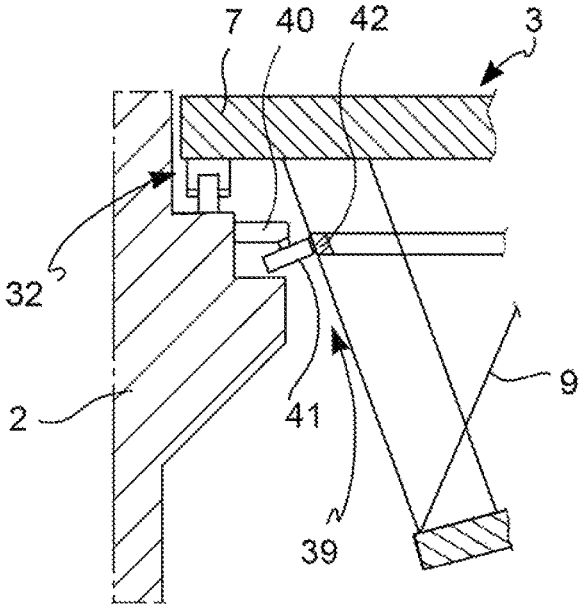
FIG. 17B is a variation of FIG. 17A, in accordance with a further embodiment, wherein the rolling track means are schematically shown as a rail-wheel assembly.

Alternatively, the motors 40 can be positioned at the exterior of the stationary core 2, close to the corresponding drive members 41 (FIGS. 16 to 17B). In this case, the auxiliary support surface 29 may support all or part of the drive means 39.

In accordance with an embodiment of the drive member 41-driven member 42 assembly, the drive member 41 is a friction wheel (e.g. a steel wheel or a rubber lined wheel) or a toothed ring, and the driven member 42 is a substantially annular friction track (e.g. a steel or tarmac or concrete surface) or a substantially annular toothed surface, extending substantially circumferentially around the stationary core 2.

In line with this embodiment, the friction track or the toothed surface is preferably fixed to the rotatable story 3, e.g. is fixed to the space frame 9, or is fixed to its upper or lower membranes 10, 11, or is directly formed on the rotatable bearing ring 37 (in an embodiment of the rolling track means 32 as a slewing bearing assembly), or is directly formed on a rail 38 fixed to the rotatable story 3 (in an embodiment of the rolling track means 32 as a rail-wheel assembly).

In accordance with the aforementioned embodiment of the drive member 41-driven member 42 assembly as a friction wheel-friction track assembly, such assembly may be complemented by a device (not illustrated in the figures) which pushes or pulls one of the friction wheel (one or more friction wheels individually or together) and the friction track towards the other one of the friction wheel (one or more friction wheels individually or together) and the friction track, thus ensuring uninterrupted contact and friction between the friction wheel and the friction track, which prevents any unintentional interruption of the motion transmission to the rotatable story 3. Said device may have the ability to be operated in reverse, thus disengaging one or more friction wheels from the friction track, e.g. for maintenance.

Figure 14:
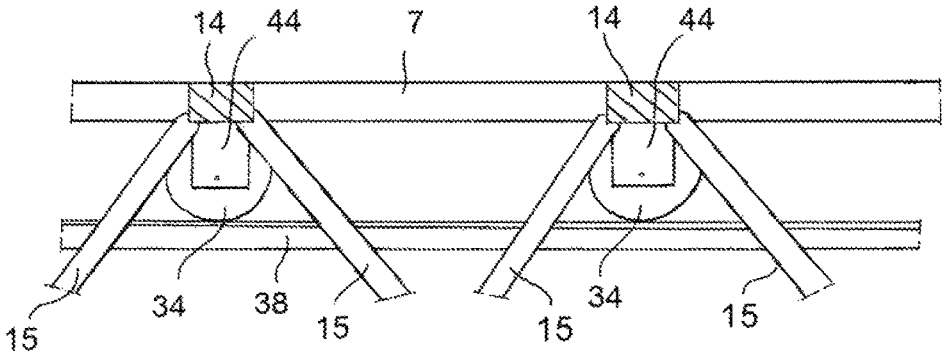
FIG. 14 is a partial side view of annular rolling track means embodied as a rail-wheel assembly, wherein the wheels are connected to the story and positioned under the space frame nodes of the radially innermost circumferential rib, and the rail is fixed to the stationary core, in accordance with an embodiment.
Figure 15A:
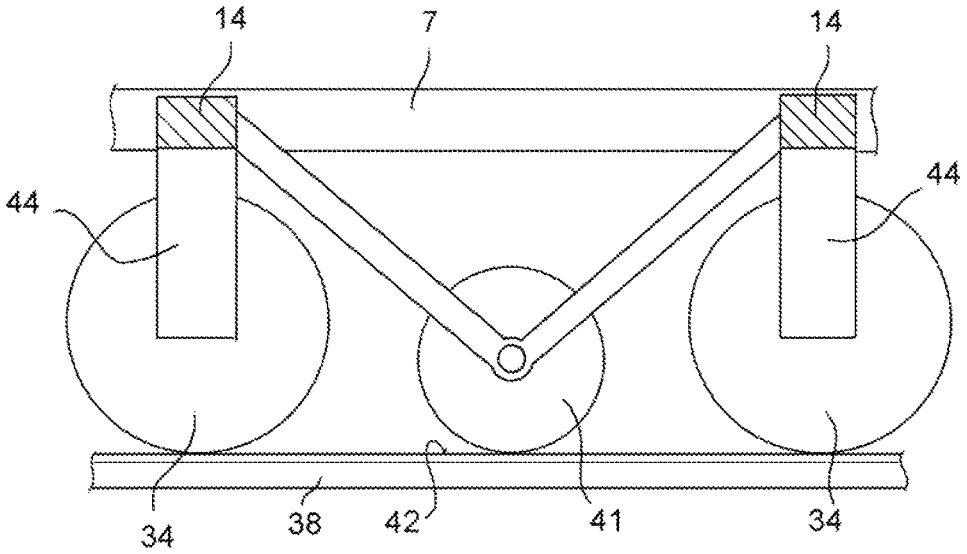
FIGS. 15A and 15B are partial side views of two possible geometric configurations of the same fundamental drive member-driven member assembly, in accordance with an embodiment, wherein the driven member, a friction track fixed to the stationary core, coincides with the rail of the rail-wheel assembly shown in FIG. 14 (although the rail is fixed to the stationary core it moves in the frame of reference of the rotatable story) and the drive member is a wheel connected to the story.
Figure 15B:
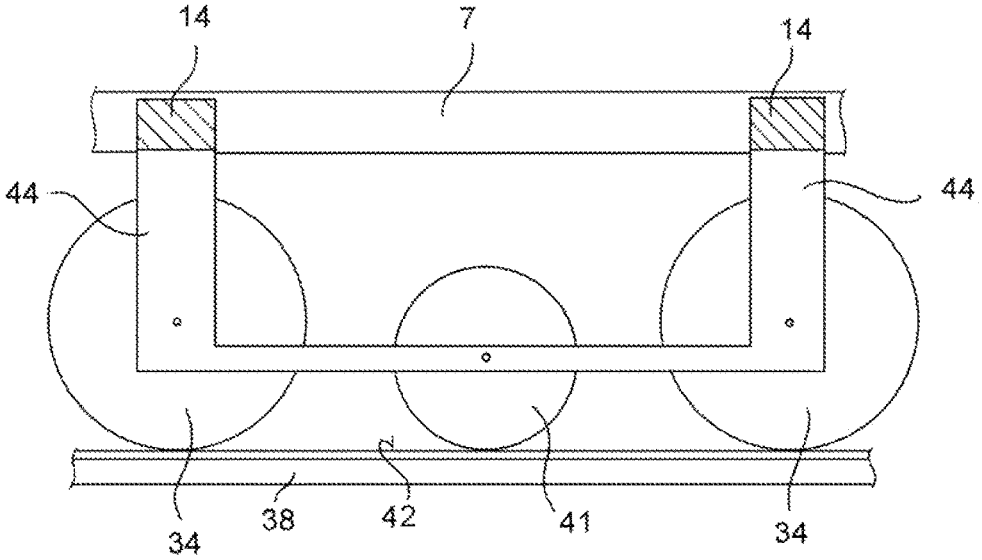

In an embodiment (shown in FIG. 18A), said electric motors 40 are positioned at the interior of the stationary core 2 and impart a motion to the corresponding drive members 41 via shafts 57 placed through stationary core 2 cavities. Every wheel 34 (in an embodiment of the rolling track means 32 as a rail-wheel assembly) is connected to the rotatable story 3, thus enabling it to be always positioned in proximity of a space frame 9 node 14 (as shown in FIG. 14), which is a structurally efficient design for the rotatable story 3.

In accordance with a further embodiment of the drive means 39, the drive means 39 comprise one or more of the rolling elements or wheels 34 of the substantially annular rolling track means 32, which are directly driven by one or more motors 40 embodied as direct drives or as gear motors connected to the corresponding rolling elements or wheels 34. Such directly driven rolling elements or wheels 34 are thus also drive members 41.

In an embodiment, one or more wheels 34 of the rolling track means 32 (in an embodiment of the rolling track means 32 as a rail-wheel assembly) are also drive members 41 and are directly driven by one or more corresponding electric motors 40, which are positioned at the interior of the stationary core 2 and impart a motion to the corresponding drive members 41 via shafts 57 placed through stationary core 2 cavities, every drive member 41 being formed by one of the wheels 34, and the driven member 42 being formed by the corresponding substantially annular rail 38 fixed to the rotatable story 3 (FIG. 18B). In this case the axis of rotation of every wheel 34 is fixed in the frame of reference of the stationary core 2. This embodiment presents the advantage of limiting the radial extension of the primary support surface 27, which is a structurally efficient design for the stationary core 2.

In an alternative embodiment, one or more wheels 34 of the rolling track means 32 (in an embodiment of the rolling track means 32 as a rail-wheel assembly) are also drive members 41 and are directly driven by one or more corresponding electric motors 40, which are positioned at the interior of the stationary core 2 and impart a motion to the corresponding drive members 41 via shafts 57 placed through stationary core 2 cavities.

The axis of rotation of every wheel 34 is fixed in the frame of reference of the stationary core 2 and every wheel 34 which is also a drive member 41 is positioned at a radial distance from the vertical axis 21 of the respective section of the core 2, which is different from the radial distance of every wheel 34 which is not also a drive member 41, e.g. so that the substantially annular rail 38 and the driven member 42 do not coincide (e.g. in order to manufacture them with different materials), as shown in FIG. 18C.

The embodiments, in which the axes of rotation of the wheels 34 are fixed in the frame of reference of the stationary core 2, require a reinforcement of the structure of the inner support portion 7 of the rotatable story 3 because said wheels 34 are, in these cases, not always positioned in proximity of a space frame 9 node 14. In these cases, in order to reduce the stresses within the inner support portion 7 when the rotatable story 3 is not moving, the latter can be positioned, when still, at a set of predetermined angles with respect to the stationary core 2, so that every wheel 34 is positioned in proximity of a space frame 9 node 14.

Alternatively, the drive member/s 41 and the driven member/s 42 can be implemented by means of meshing gears or pulley-belt transmissions.

In accordance with a further embodiment of the drive means 39, the drive means 39 comprise one or more linear motors imparting a rotation to a rotatable story 3 via electromagnetic propulsion. These linear motors comprise a stator 55 fixed to the stationary core 2 and a rotor 56 fixed to the rotatable story 3, or vice versa.

Figure 19A:
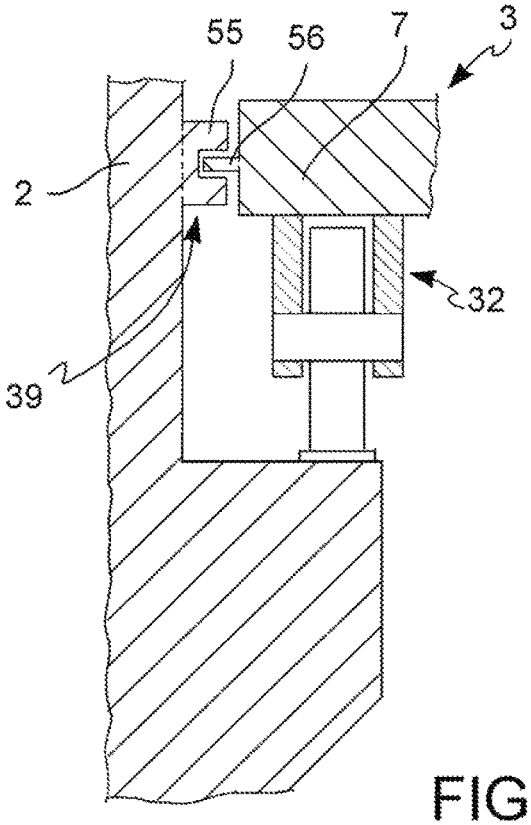
FIG. 19A is a partial vertical cross-section view of a building in accordance with a further embodiment, showing a drive equipment for imparting a rotation to a rotatable story about a stationary core, wherein the drive equipment comprises a linear motor made from a C-shaped stator and a substantially annular rotor running through the stator.
Figure 19B:
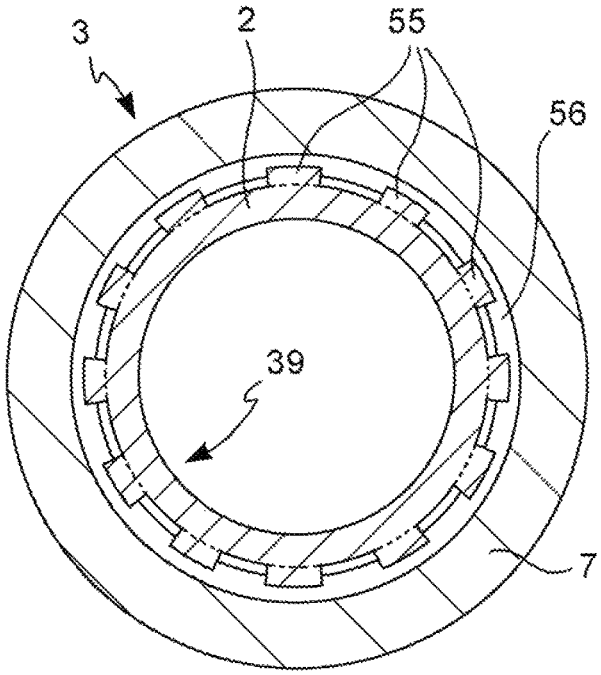
FIG. 19B is a horizontal cross-section view of the device in FIG. 19A, showing several C-shaped stators and a rotor running substantially circumferentially through the stators.

In accordance with the linear motor embodiment of the drive means 39, the stator 55 may comprise a number of C-shaped elements positioned along an outer circumference of the stationary core 2, and the rotor 56 may comprise a substantially annular rail extending along an inner circumference of the rotatable story 3, the rail running through every C-shaped element (FIGS. 19A and 19B).

Figure 19C:
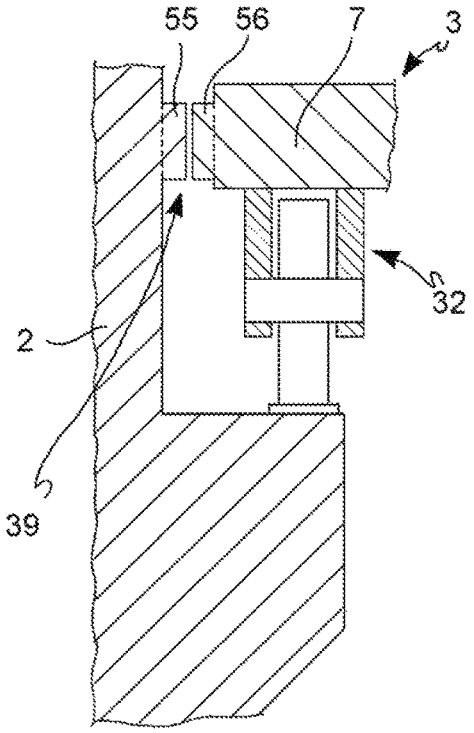
FIG. 19C is a partial vertical cross-section view of a building in accordance with a further embodiment, showing a drive equipment for imparting a rotation to a rotatable story about a stationary core, wherein the drive equipment comprises a linear motor made from two substantially annular rails, one forming a stator fixed to the core and one forming a rotor fixed to the rotatable story.
Figure 19D:
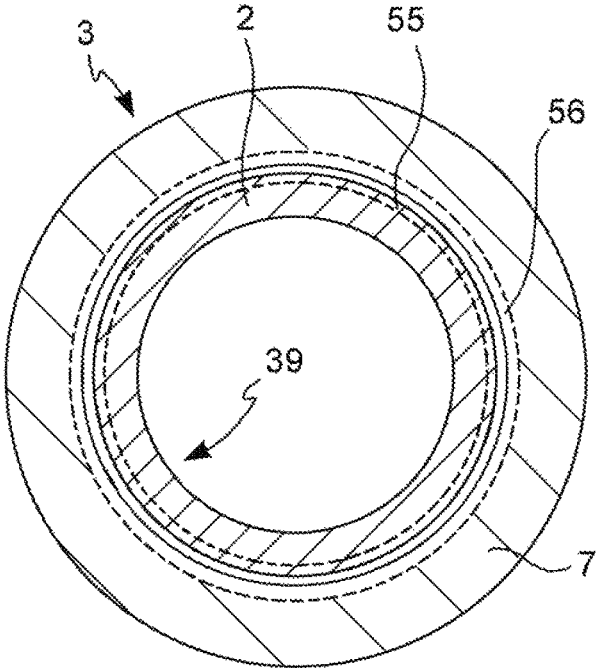
FIG. 19D is a horizontal cross-section view of the device in FIG. 19C.

In accordance with the linear motor embodiment of the drive means 39, the stator 55 may alternatively comprise a substantially annular rail extending along an outer circumference of the stationary core 2, and the rotor 56 may comprise a substantially annular rail extending along an inner circumference of the rotatable story 3, the stator 55 and rotor 56 being radially spaced from each other and both substantially included in the rotation plane 35 of the story 3 (FIGS. 19C and 19D).

In order to avoid any risk of unwanted movement of a rotatable story 3, a system comprising one or more mechanical devices (not illustrated in the figures), e.g. one or more brakes and/or clamps and/or pins, may be positioned in proximity of the rotatable story 3. Said mechanical devices may each comprise one part fixed to the rotatable story 3 and one part fixed to the stationary core 2, and/or to another story 3, which, by engaging with each other, prevent any movement of the rotatable story 3. This is useful, for example, in the aforementioned case of the rotatable story 3 being required to be positioned, when still, at one of a set of predetermined angles with respect to the stationary core 2.

Thanks to the free space between the struts 15 of the space frame 9, and to the rotatable story 3 being coupled to the stationary core 2 via only one interface 8, e.g. by only one annular rolling track means 32, the coupling region is easily accessible during the initial mounting of the rotatable story 3 and during the installation, maintenance, repair or replacement of the items present in the internal environment 20 and of all or part of the drive means 39.

As previously mentioned, the auxiliary support surface 29 may support auxiliary story support means 31. The auxiliary story support means 31 may be used for the purposes of maintenance of the rolling track means 32 and/or of all or part of the drive means 39 and/or of any other item present in the internal environment 20. Alternatively, or in addition, the auxiliary story support means 31 may be used as emergency story 3 lock-out means to prevent the story 3 from rotating.

In accordance with an embodiment, the auxiliary story support means 31 comprise a plurality of lifting jacks 43 for temporary vertical displacement of the entire story 3, or even only part of the story 3, with respect to the core 2, from a predetermined operating position to a maintenance position, which allows access to and maintenance and/or replacement of items present in the internal environment 20, following which the lifting jacks 43 ease the entire story 3, or part of the story 3, back to the operating position (FIGS. 20A and 20B).

The lifting jacks 43 can be positioned on the auxiliary support surface 29 or on the primary support surface 27 of the core 2, and engage the inner substantially annular support portion 7 of the story 3.

The drive member/s 41 and the driven member/s 42 must be configured in such a way that they can be easily disengaged to allow the lifting of the entire story 3, or in such a way that they automatically disengage when the story 3 is lifted.

Figure 21:
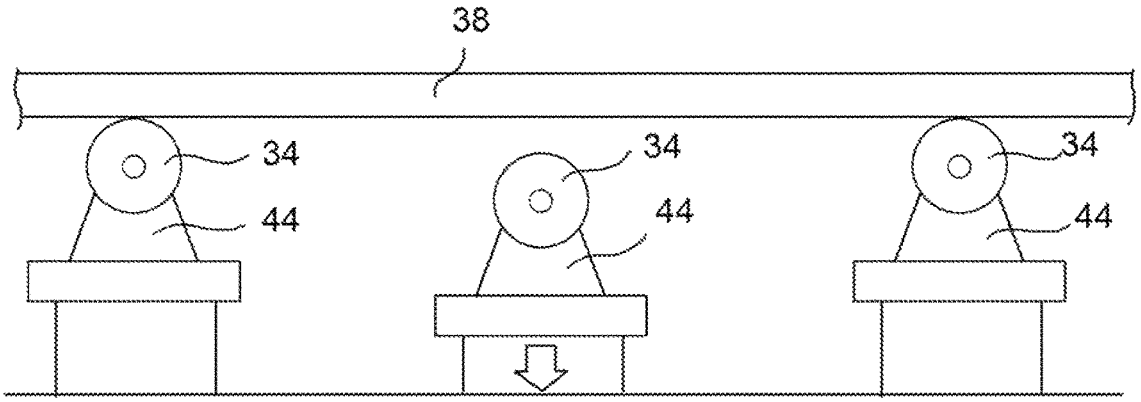
FIG. 21 is a partial schematic side view of the rolling track means, embodied as a rail-wheel assembly, showing an individual disengagement operation of a wheel from a rail of the rolling track means, for the purpose of maintenance and/or replacement of components of the rolling track means.

In an alternative embodiment, the wheel suspensions or wheel holders 44 (in an embodiment of the rolling track means 32 as a rail-wheel assembly) can be individually height-adjustable in order to allow a selective disengagement of an individual wheel 34 from the rolling track 33 for the purpose of maintenance and/or wheel 34 replacement (FIG. 21).

Figures 22A, 22B:
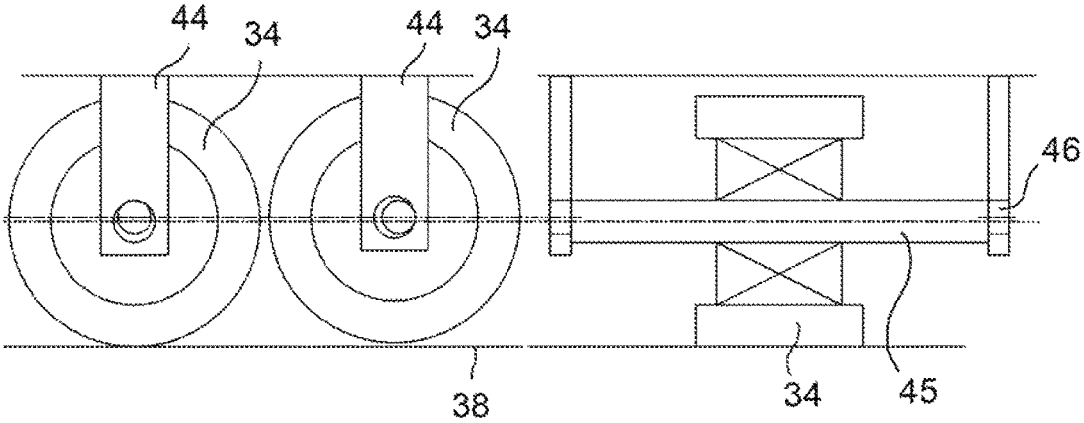
FIG. 22A is a partial schematic side view of annular rolling track means, embodied as a rail-wheel assembly, in accordance with an embodiment wherein an individual wheel rotates around an eccentric portion of a rotatably adjustable wheel axle.
FIG. 22B is a partial schematic radial cross-section view of the annular rolling track means in FIG. 22A.
Figure 22C:
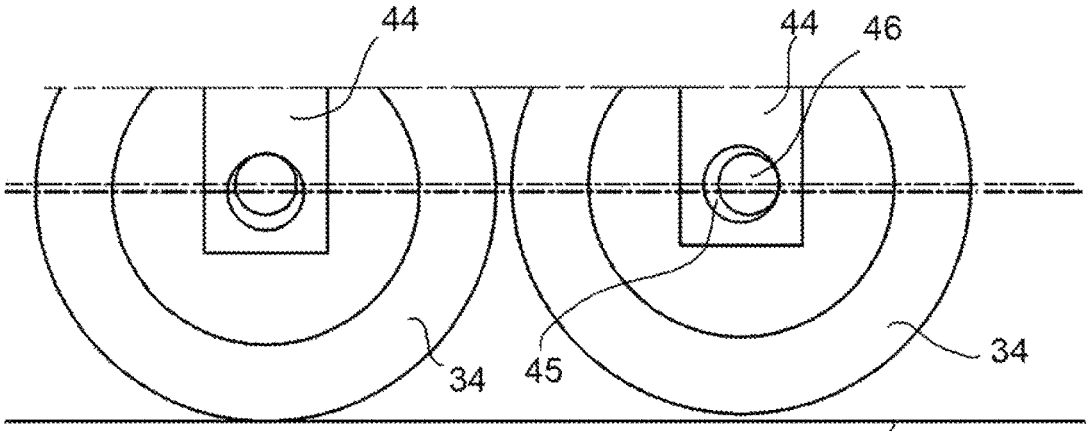
FIG. 22C is a magnified view of a detail in FIG. 22A.
Figure 28:
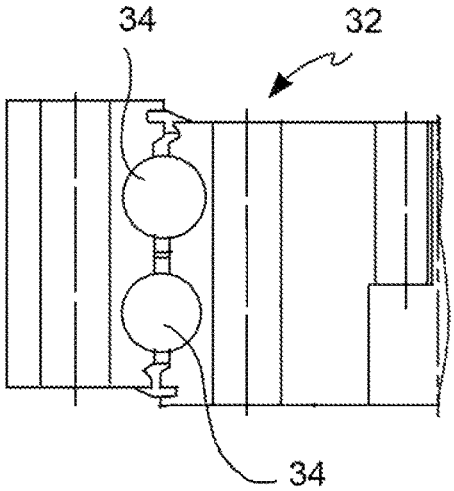
Figure 29:
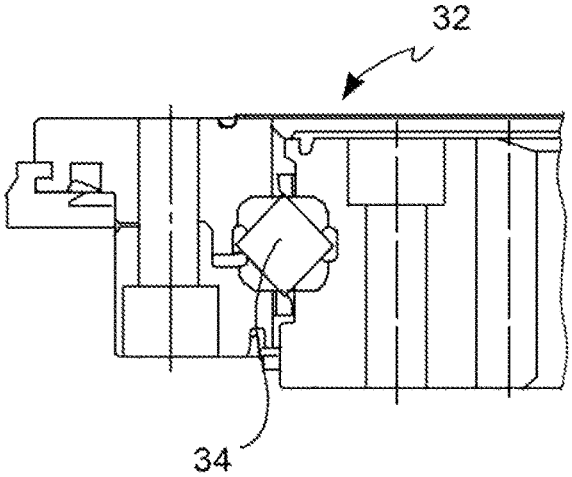

In yet a further embodiment, one or more of the single wheels 34 (in an embodiment of the rolling track means 32 as a rail-wheel assembly) are supported on and rotate around the respective eccentric portions 45 of rotatably adjustable wheel axles 46, which can be each turned in a working position in which the eccentric portion 45, together with the wheel 34, is turned vertically towards the rail 38, and in a maintenance position in which the eccentric portion 45, together with the wheel 34, is turned vertically away from the rail 38, thereby detaching the individual wheel 34 from the rail 38 for the purpose of maintenance and/or wheel 34 replacement (FIGS. 22A to 22C).

In accordance with embodiments, the rotatable story 3 comprises a bottom plate structure 47 having a lower cover structure (membrane) 11 and an upper cover structure (membrane) 10, both in pre-stressed concrete or reinforced concrete or in steel, and the space frame 9 is sandwiched in between and connecting the lower and upper cover structures 11, 10 (FIG. 2). The space frame 9 may be in steel or in reinforced concrete. Preferably, the space frame 9 is formed by a pattern of truss-triangles or beam-triangles. The upper cover structure 10 forms a substantially horizontal upper surface on which a pavement 17 can be laid, whereas the lower cover structure 11 forms a lower delimitation surface, which closes the bottom plate structure 47 from below and protects the space frame 9 against exposure to the external environment 19.

The vertical height of the bottom plate structure 47 and of the space frame 9 decreases gradually from a radially internal region (e.g. near the inner support portion 7) towards a radially external region (e.g. near the outer peripheral portion 5) thereof in order to better resist against flexural cantilever loads.

The dwelling space of the stories 3 is defined by a wall 48, a ceiling 16 and an outer surface 6 enveloping structure built on the bottom plate structure 47.

A minimum free clearance 49 of e.g. at least 5 cm, preferably 5 cm to 50 cm, even more preferably of approximately 30 cm, is provided between the roof 26 of one story 3 and the bottom plate structure 47 of the story 3 directly above it. This tolerance clearance 49 allows for relative rotation of neighboring (above-below) stories 3 without space violation, even in the event of different vertical loads and wind.

Building installations 50, such as piping, tubing, electrical power lines, signal lines, air conditioning, ventilation equipment, can be advantageously arranged in the free space between the space frame 9 struts 15 and in the free space between the roof 26 of one story 3 and the lower cover structure or membrane 11 of the story 3 above it.

The inner substantially annular support portion 7 may be formed by a reinforced stiff radially internal edge region of the upper cover structure or membrane 10.

The building structure 1 can be a multilevel building with independently rotatable stories 3. It should be understood that the structure of this invention encompasses applications to high-rise and/or low-rise buildings. Each of several stories 3 can rotate in opposite circular directions or, optionally, in the same circular direction. The stories 3 can also rotate at different speeds.

The stationary central core 2 is preferably cylindrical in shape or shaped as a succession of cylinders of different radii, and constructed of reinforced concrete, structural steel or equivalent materials. The core 2 is designed to support the total live and dead load of the story/ies 3. The story 3 surrounds the core 2 and provides for a substantially balanced load transfer to the core 2. The story 3 substantially fully encircles the core 2 and preferably defines a substantially circular disk body.

It should be noted that, in the presence of two or more stories 3, one or more stories 3 may be of different radial dimensions from those of one or more other stories 3, so as to create a non-cylindrical building profile (FIG. 1A).

Although the story 3 has been described as having a substantially circular outer periphery while surrounding the core 2, alternative story 3 configurations, e.g. square, ellipsoid, or non-symmetric shapes, are within the scope of this invention and may provide a continually changeable building profile during story 3 rotation. In the presence of two or more stories 3, the stories 3 can be of different shapes, which may further provide a continually changeable building profile during the rotation of the stories 3. Stories 3 may also have different axes of substantial symmetry at different elevations, which may lead to a non-symmetrical building structure 1 with respect to a vertical axis, even in the absence of rotation. Counterweights may be applied to achieve a more balanced loading, where appropriate.

Elevator shafts 51, emergency stairways 52, as well as the mechanical, electrical and plumbing components including HVAC, water supply systems, trash disposal, electrical power cables, and utility lines such as telephone, computer and television, jointly designated 53, are all housed within the stationary core 2 (FIG. 1B). It should also be noted that the core 2 has one or more passage openings 54 to provide passageways from the story 3 to the interior of the core 2, for example, for occupants to access the elevator shafts 51 (FIG. 1B).

Although preferred embodiments of the invention have been described in detail, it is not the intention of the applicant to limit the scope of the invention to such particular embodiments, but to cover all modifications and alternative constructions falling within the scope as defined by the claims.

The invention claimed is:

1. A building structure (1) comprising:

a stationary core (2) extending upright through and supporting weight of one or more rotatable stories (3) of the building structure (1), each story (3) comprising one or more floor units (4), said story (3) forming an outer peripheral portion (5) which defines an outer surface (6) of the story (3), and an inner support portion (7) through which the story (3) is supported by the core (2) via an interface (8) along an external perimeter of the core (2), wherein a horizontal cross-section of the core (2) has a substantially circular said external perimeter at the interface (8), the interface (8) and the inner support portion (7) of the story (3) hence being both of substantially annular shape, wherein said story (3) is stiffened by a space frame (9) extending from the inner support portion (7) to the outer peripheral portion (5) and making the story (3) a self-supporting rigid body cantilevered off the core (2) and structurally independent of all other stories (3), wherein the story (3) transmits gravity-induced loads to the core (2) via the interface (8) only by means of vertical forces, wherein the space frame (9) comprises a truss-shaped, lightweight rigid structure constructed from interlocking struts (15) in a geometric pattern, the space frame (9) has an upper and a lower membrane (10, 11), each membrane (10, 11) having a number of substantially radial ribs (12) and substantially circumferential ribs (13) intersecting each other in nodes (14) of said space frame (9), all the nodes (14), from which the struts (15) extend, are placed at the intersection of one of said substantially radial ribs (12) and one of said substantially circumferential ribs (13), and horizontal gravity-induced loads are self-balanced within the ribs (12, 13) and in the membranes (10, 11), wherein a separation device (18) located between two of the stories (3) separates an external environment (19) of the building structure, which is in contact with all atmospheric elements, from an internal environment (20) of the building structure, which is in contact with the space frame (9) and the interface (8).

2. The building structure (1) according to claim 1, wherein the separation device (18) comprises a brush (22) extending substantially circumferentially around a vertical axis (21) of a respective section of the supporting core (2).

3. The building structure (1) according to claim 1, wherein the separation device (18) comprises a liquid seal (23) extending substantially circumferentially around a vertical axis (21) of the respective section of the supporting core (2), and comprising a trough (24) containing a liquid, and a separation lip or wall or sheet (25) projecting into the trough (24) and being immersed in said liquid, wherein the trough (24) is fixed to one story (3) or to the core (2), and the separation lip or wall or sheet (25) is fixed to a vertically neighboring story (3), or vice versa.

4. The building structure (1) according to claim 1, comprising a plurality of lifting jacks (43) for temporary vertical displacement of an entirety of the story (3), or only part of the story (3), with respect to the core (2), from a predetermined operating position to a maintenance position, which allows at least one of (i) access to and maintenance or (ii) replacement of items present in the internal environment (20).

5. The building structure (1) according to claim 1, wherein horizontal surfaces of the separation device (18) are covered with damping layers made of shock absorbing material forming a damper during extreme events.

6. The building structure (1) according to claim 5, wherein the extreme events are earthquakes.

7. The building structure (1) according to claim 1, wherein the interface (8) between the inner substantially annular support portion (7) of the story (3) and the core (2) comprises a device enabling a rotatable coupling of said inner annular support portion (7) of the story (3) to said stationary core (2), thus enabling the story (3) to rotate about the stationary core (2), independently of any of the other stories (3), in a substantially horizontal story (3) rotation plane (35).

8. The building structure (1) according to claim 7, wherein the interface (8) between the inner support portion (7) of the story (3) and the core (2) comprises rolling track means (32) having an annular rolling track (33) extending substantially circumferentially around the stationary core (2) and fixed to one of the stationary core (2) and the inner support portion (7) of the story (3), and a plurality of rolling elements or wheels (34) held by the other one of said stationary core (2) and the inner support portion (7) of the story (3), and rollably engaging the annular rolling track (33).

9. The building structure (1) according to claim 8, wherein the rolling track means (32) comprise a rail-wheel assembly having a single substantially annular rail (38) forming the rolling track (33), and a plurality of wheels (34) arranged to abut on the single rail (38) and adapted to roll along the single rail (38) to enable the rotation of the rotatable story (3) about the stationary core (2).

10. The building structure (1) according to claim 8, wherein one or more of the wheels (34) are supported on an eccentric portion (45) of a rotatably adjustable wheel axle (46) which is configured to be turned:

in a working position in which the eccentric portion (45), together with the wheel (34), is turned vertically towards the rail (38), in a maintenance position in which the eccentric portion (45), together with the wheel (34), is turned vertically away from the rail (38), thereby detaching the individual wheel (34) from the rail (38) for the purpose of at least one of maintenance or replacement.

11. The building structure (1) according to claim 7, comprising drive means (39) to impart a rotational motion to the rotatable story (3) about the stationary core (2).

12. The building structure (1) according to claim 11, wherein the drive means (39) comprise one or more motors (40) associated to said rotatable story (3), said motors (40) being positioned along a circumference of the stationary core (2) and configured to impart a motion to one or more drive members (41) connected to one of the stationary core (2) and the rotatable story (3), said drive members (41) engaging one or more corresponding driven members (42) connected to the other one of the stationary core (2) and the rotatable story (3), to rotate the story (3) about the stationary core (2).

13. The building structure (1) according to claim 12, wherein:

the drive member (41) comprises either a friction wheel or a toothed ring, the driven member (42) extends circumferentially around the stationary core (2) and comprises either an annular friction track having a steel or tarmac or concrete surface or an annular toothed surface.

14. The building structure (1) according to claim 12, wherein the drive member (41) imparts a motion to the driven member (42) via meshing gears or via pulley-belt transmissions.

* * * * *